US006748909B2

(12) United States Patent
Drecq

(10) Patent No.: US 6,748,909 B2
(45) Date of Patent: Jun. 15, 2004

(54) INTERNAL COMBUSTION ENGINE DRIVING A COMPRESSOR

(76) Inventor: Daniel Drecq, 8, rue Octave Allaire, 78610, Saint Leger en Yvelines (FR)

( * ) Notice: Subject to any disclaimer, the term of this patent is extended or adjusted under 35 U.S.C. 154(b) by 162 days.

(21) Appl. No.: 10/024,206

(22) Filed: Dec. 21, 2001

(65) Prior Publication Data

US 2002/0108589 A1 Aug. 15, 2002

Related U.S. Application Data

(63) Continuation-in-part of application No. 09/477,354, filed on Jan. 4, 2000, now Pat. No. 6,352,057.

(30) Foreign Application Priority Data

Jan. 7, 1999 (FR) ..... 99 00093
Sep. 7, 1999 (FR) ..... 99 11162

(51) Int. Cl.[7] ..... F02B 33/04
(52) U.S. Cl. ..... 123/66; 123/197.3; 123/72
(58) Field of Search ..... 123/66, 72, 197.3, 123/70 R, 195 AC

(56) References Cited

U.S. PATENT DOCUMENTS

| | | | | |
|---|---|---|---|---|
| 1,449,726 A | * | 3/1923 | Benskin | 123/59.1 |
| 1,873,908 A | * | 8/1932 | Schinke | 74/44 |
| 2,167,402 A | * | 7/1939 | Giro | 123/59.7 |
| 2,346,458 A | * | 4/1944 | Sanders | 123/501 |
| 2,542,707 A | | 2/1951 | Ricardo et al. | |
| 2,609,802 A | | 9/1952 | Schnurle et al. | |
| 2,726,646 A | | 12/1955 | Black | |
| 4,974,554 A | | 12/1990 | Emery | |
| 5,299,537 A | | 4/1994 | Thompson | |
| 5,660,151 A | | 8/1997 | Yoshizawa | |

FOREIGN PATENT DOCUMENTS

| | | |
|---|---|---|
| AT | 313458 | 6/1973 |
| DE | 807566 | 4/1951 |
| DE | 808297 | 5/1951 |
| DE | 175413 | 7/1953 |
| DE | 42 36 899 A1 | 5/1994 |
| EP | 1 018 597 A1 | 7/2000 |
| EP | 1 039 113 A2 | 9/2000 |
| WO | WO 93/18287 | 9/1993 |
| WO | 01/48380 A1 | 7/2001 |

* cited by examiner

*Primary Examiner*—Mahmoud Gimie
(74) *Attorney, Agent, or Firm*—Young & Thompson

(57) ABSTRACT

A two-stroke or four-stroke internal combustion engine operates by admitting a carburated mixture or by admitting fresh air with the direct or indirect injection of fuel. The engine has at least one cylinder, which defines a variable-volume combustion chamber in which an engine piston, coupled by a connecting rod to the wrist pin of a crankshaft, executes a reciprocating movement. A compressor associated with each cylinder to supercharge the cylinder with carbureted mixture or with fresh air has at least one stage and, in the compression chamber, a compressor piston moves and is coupled to the crankshaft by a link rod articulated to an eccentric mounted on the shaft of the crankshaft.

35 Claims, 16 Drawing Sheets

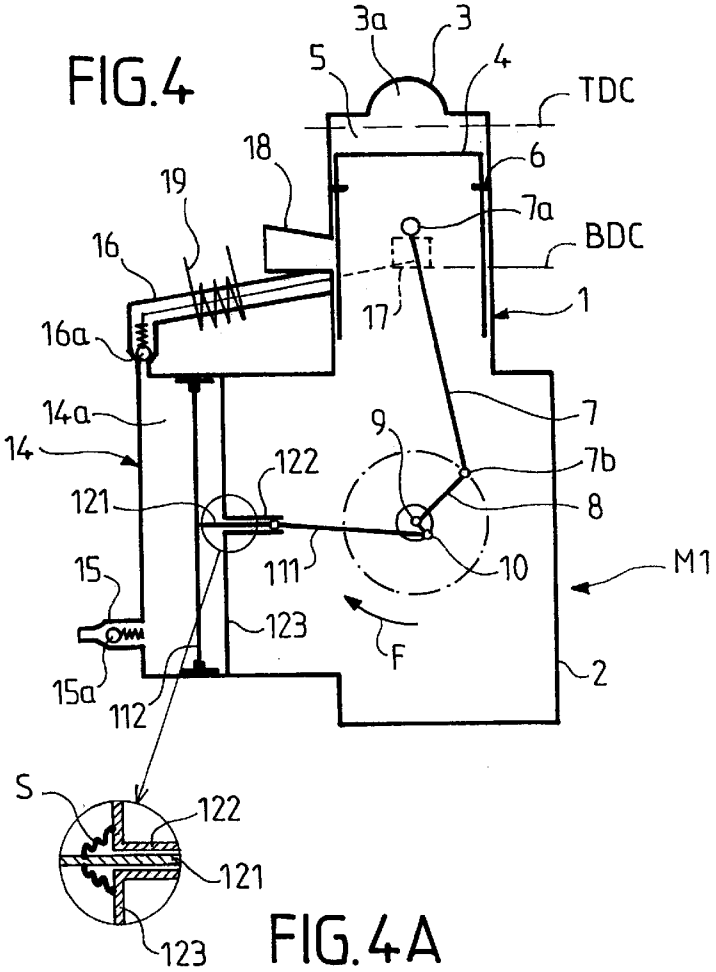
FIG.4
FIG.4A
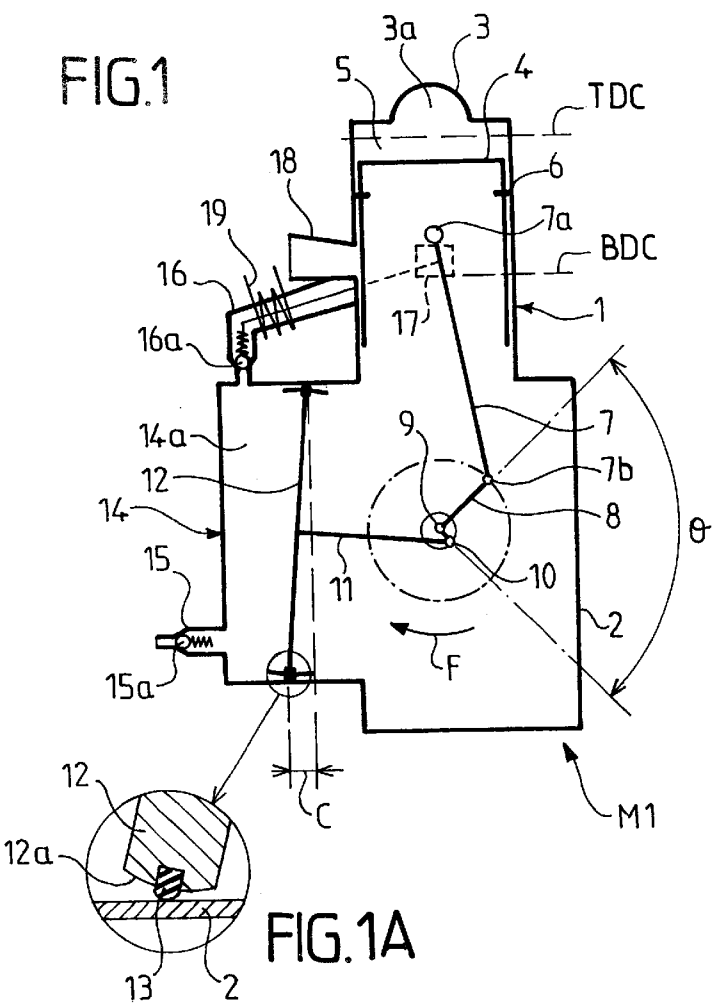
FIG.1
FIG.1A

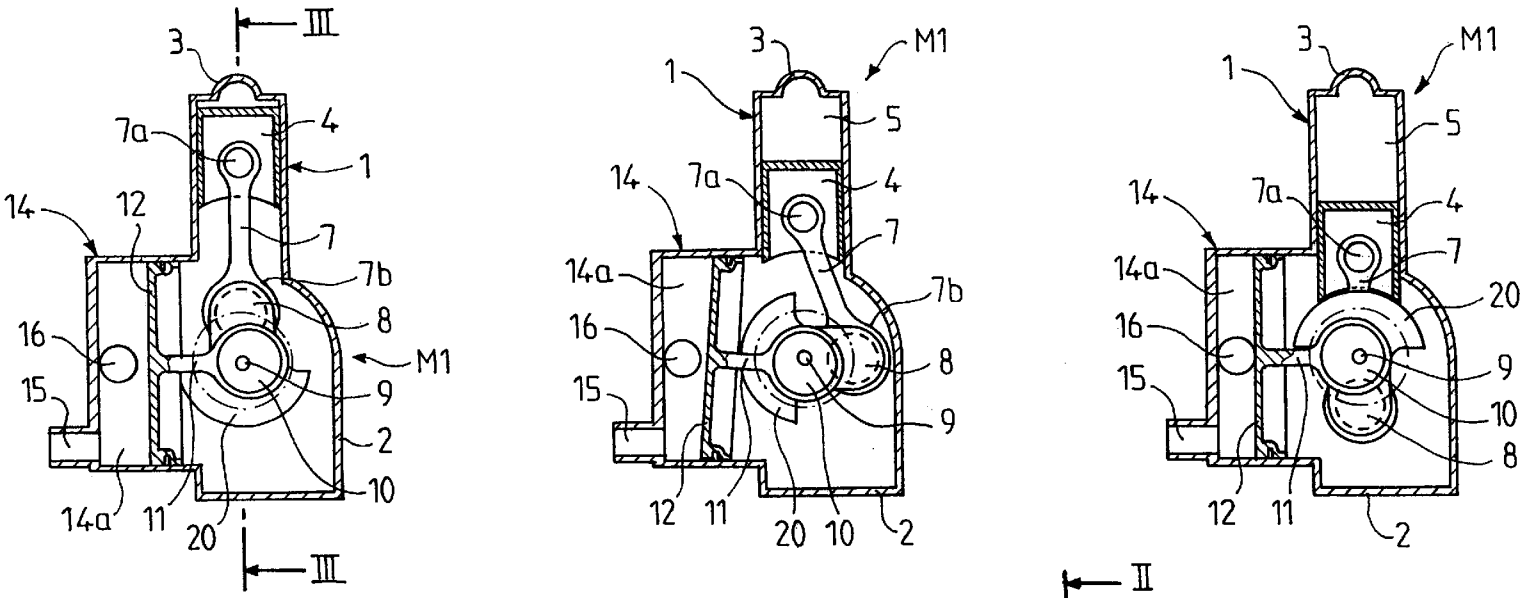
FIG.2A
FIG.2B
FIG.2C
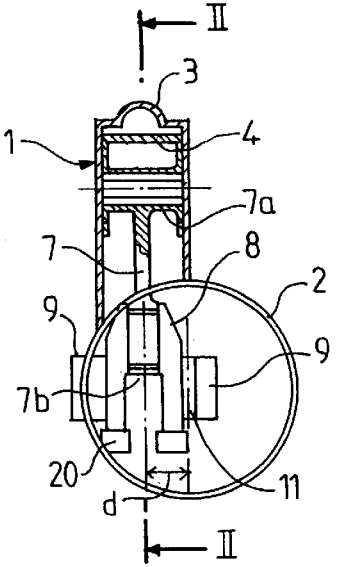
FIG.3
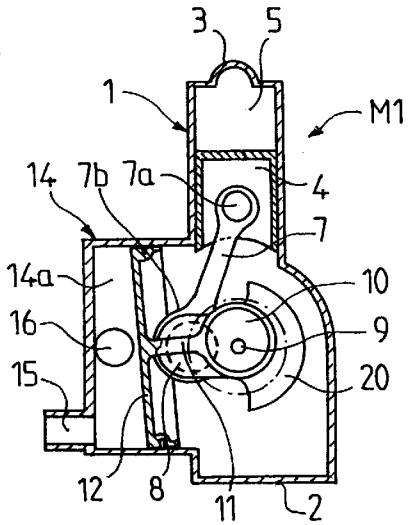
FIG.2D

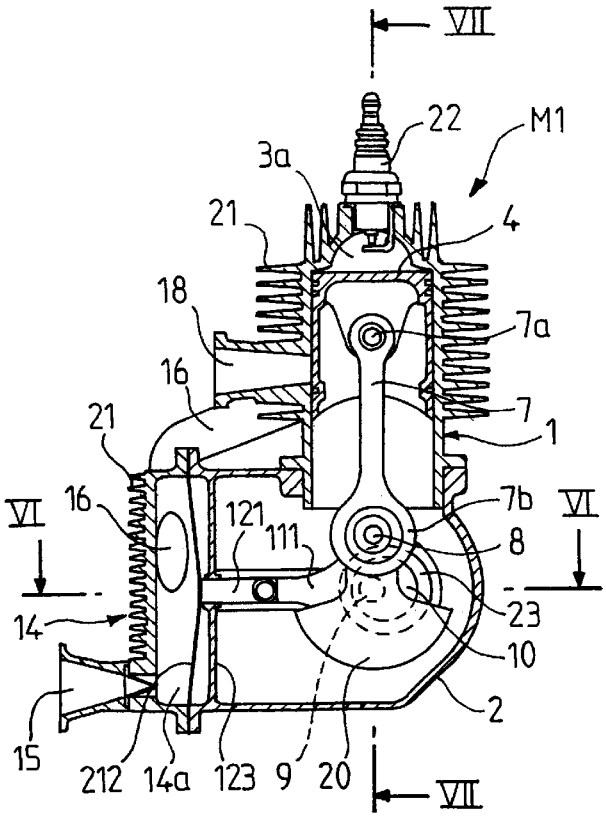
FIG.5A
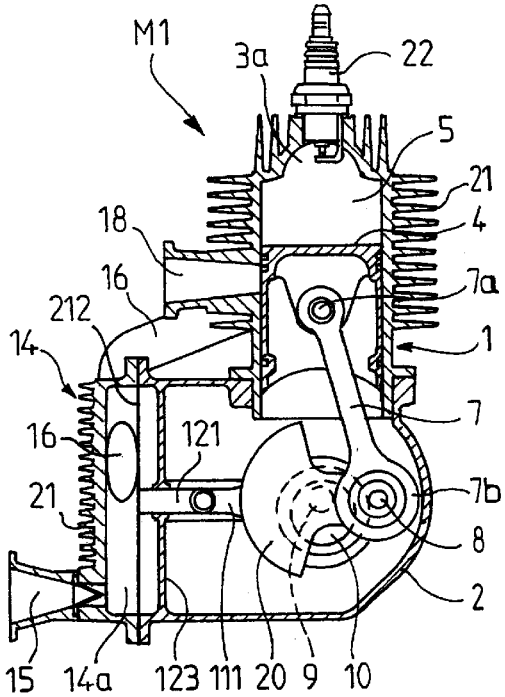
FIG.5B
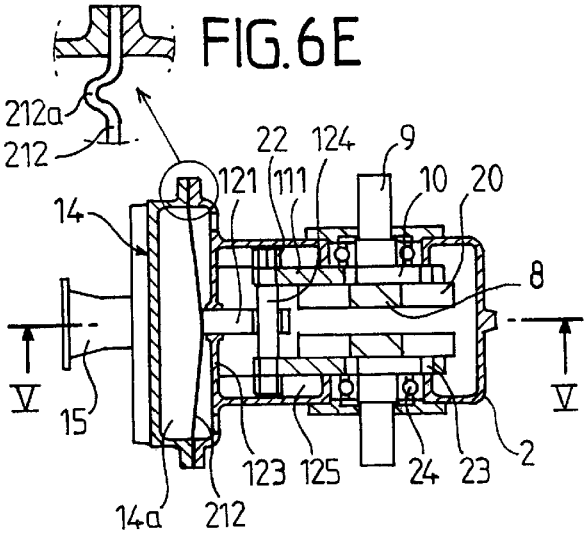
FIG.6E
FIG.6A
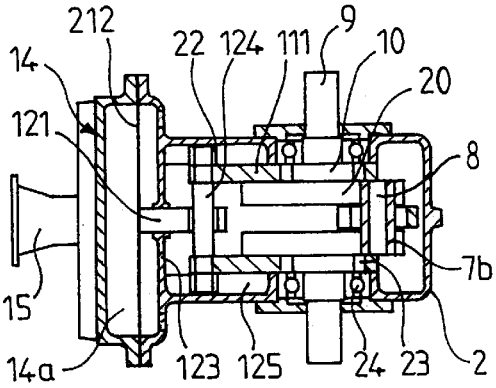
FIG.6B

F1
F2
F3
F4
F
M4
1
2
4
5
7
7a
8
9
10
11
12
14
14a
15
15a
16
16a
118
118a
217

INTERNAL COMBUSTION ENGINE DRIVING A COMPRESSOR

CROSS-REFERENCE TO RELATED APPLICATIONS

This application is a Continuation-in-Part of U.S. patent application Ser. No. 09/477,354 filed Jan. 04, 2000 now U.S. Pat. No. 6,352,057, the entire contents of which are herein incorporated by reference, and for which domestic priority under 35 U.S.C. §120 is claimed. This application also claims priority under 35 U.S.C. §119 from French Applications No. 01 16280 filed Dec. 17, 2001; 99 00093 filed Jan. 7, 1999; and 99 11162, filed Sep. 7, 1999.

FIELD OF THE INVENTION

The present invention relates to a supercharged two-stroke or four-stroke internal combustion engine having one or more cylinders, and operating by admitting a carburated mixture or by admitting fresh air with the direct or indirect injection of fuel. The invention is just as applicable to petrol engines equipped with spark plugs as it is to diesel engines which use compression ignition.

Although the invention is described hereinafter with more particular reference to a single-cylinder engine in the case of a two-stroke engine, which is well suited to all applications of small industrial engines intended for motorized cultivation, garden tools, lawn mowers, cutters, scrub clearers or the like, the invention is not in any way restricted thereto and is also applicable to two-stroke or four-stroke multi-cylinder in-line or V engines.

BACKGROUND OF THE INVENTION

A two-stroke single-cylinder engine which operates with natural aspiration into the cylinder of a carburated mixture which passes through the crankcase is already known. This engine has a pipe for admitting the air/fuel mixture and a pipe for exhausting the burnt gases, both of which pipes open in the form of ports toward the bottom of the cylinder, near bottom dead center (BDC). The carburated mixture from the carburetor is drawn into the crankcase through a valve, during the upstroke of the piston which causes a depression in the crankcase, and is then delivered to the cylinder, during the downstroke of the piston, causing a raised pressure in the crankcase. During the downstroke of the piston, the mixture inlet ports are open at practically the same time as the exhaust ports, which means that about 20% of the mixture is discharged directly to the exhaust, leading to a high fuel consumption and a great deal of atmospheric pollution. The main advantage of this engine is its low cost, but new antipollution standards will ultimately spell the end for this type of engine.

Another known engine is of the loop scavenging type, which operates with a positive-displacement compressor, for example of the Roots type, making it easier to introduce the carburated mixture into the cylinder and to generate low-pressure supercharging. This engine also has a mixture inlet pipe and an exhaust pipe, the pipes both opening via ports toward the bottom of the cylinder. In this engine, the carburated mixture is admitted into the cylinder from the compressor, with an orientation such that the mixture experiences a loop-like upward rotating movement after the manner of a "loop-the-loop" in the cylinder, while the burnt gases from the previous cycle are discharged to the exhaust ports. The particular arrangement of the inlet and exhaust ports makes it possible for part of the admitted mixture not to be exhausted directly, and this reduces both fuel consumption and environmental pollution.

Yet another known engine is of the uniflow type, which also operates using a positive-displacement compressor. This engine has an inlet pipe connected at its upstream end to the compressor and at its downstream end to an inlet ring which opens via a number of ports toward the bottom of the cylinder, with an orientation such that the mixture is introduced with a great deal of rotational movement. The burnt gases are discharged at the top of the cylinder through one or more exhaust valves. This type of engine allows control over the filling of the cylinder and the possible recirculation of burnt gases, so as to obtain combustion which causes less pollution. Furthermore, when this type of engine is operating on the diesel cycle, introducing the air near the bottom of the cylinder makes it possible to obtain a great deal of air rotation, which is needed for obtaining good efficiency. This engine makes it possible to consume even less fuel than the loop-scavenging engine, and also makes it possible to reduce polluting emissions.

However, these last two types of engine cost far more than engines with transfer via the crankcase, because they contain more parts, particularly the compressor, and furthermore, in the case of the uniflow engine, valve control means. Furthermore, compressors of the Roots type are of low efficiency; for example, a two-stroke single-cylinder engine with a one-liter cylinder capacity and a power of 55 kW will consume 17 kW for driving the compressor. What is more, a Roots compressor does not operate beyond a pressure higher than 1.2 bar.

Finally, engines with exhaust and inlet valves are known and these are able to obtain the lowest consumptions and the lowest emissions, but this type of engine is also the most expensive because both the exhaust valves and the inlet valves have to be controlled. The efficiency of this engine is better because the control of the opening and closing of the valves using parts external to the cylinder means that the entire piston stroke can be used whereas with the previous engines in which admission was via ports, part of the compression stroke and of the expansion stroke was lost.

SUMMARY OF THE INVENTION

The object of the invention is to provide a supercharged two-stroke or four-stroke internal combustion engine, for example of the loop scavenging, uniflow or valve type, or of the four-stroke valves type, which allows the efficiency to be improved and the emissions to be reduced.

To this end, the subject of the invention is a two-stroke or four-stroke internal combustion engine, operating by admitting a carburated mixture or by admitting fresh air with the direct or indirect injection of fuel, the engine having at least one engine cylinder, an engine piston which executes a reciprocating movement in said engine cylinder, said engine piston coupled by a connecting rod to the wrist pin of a crankshaft so as to drive said crankshaft in rotation, and at least one compressor having a compressor cylinder and a compressor piston engaged in said compressor cylinder so as to define at least one variable-volume compression chamber, wherein said compression chamber is connected to said engine cylinder by an inlet pipe in order to supercharge the engine cylinder with carburated mixture or with fresh air, said inlet pipe ending at an inlet member of the engine cylinder, wherein said engine comprises a coupling means for coupling said compressor piston to said crankshaft, said coupling means arranged to drive said compressor piston in a reciprocating movement in said compressor cylinder as said crankshaft rotates so that, at least at a predetermined operating speed, a supercharging pressure generated by said compressor piston in the compression chamber and propagated through said inlet pipe, reaches a maximum value in said engine cylinder at substantially the same time as the inlet member of said engine cylinder is shut off.

This feature makes it possible to obtain a supercharged engine in which combustion is more complete, thus increasing efficiency and reducing exhaust pollution. The choice of producing the maximum pressure in the combustion chamber of the engine cylinder at substantially the same time as the inlet member is shut off makes it possible, for the desired operating speed, to optimize the amount of fresh air or carbureted mixture introduced into the engine cylinder in each cycle, while at the same time controlling the richness of the mixture, thus increasing the torque and mechanical power. It should be noted that a phase shift between the top dead center of the compression piston and the top dead center of the engine piston is chosen so as to obtain a maximum pressure in the engine cylinder at the time that the inlet member is shut off so that the geometric value of this phase shift can vary to a large extent as a function of numerous constructional and operational parameters of the engine and of the compressor.

According to a particular embodiment of the invention, the coupling means comprises a cam follower member connected to said compressor piston to drive said compressor piston, said cam follower member being kept in contact with a cam profile carried by said crankshaft during at least part of a rotation cycle of said crankshaft, said cam profile being designed to drive said compressor piston via the cam follower member, with a reciprocating movement in said compressor cylinder as said crankshaft rotates.

As a preference, the crankshaft has a counterweight part which is off-centered away from said wrist pin to balance said crankshaft, part of said cam profile being carried by said counterweight part.

The counterweight is a part of the crankshaft which always has a great deal of asymmetry with respect to the axis of rotation of the crankshaft. As a result, producing a cam profile with the desired shape on the counterweight does not involve significant modification to the structure of the crankshaft, and this makes it possible to reduce the cost of obtaining the compressor.

Advantageously in this case, the cam follower member has the overall shape of a U with two branches and collaborates with said counterweight part of the crankshaft on each side of said wrist pin via respective ends of the two branches of said cam follower member.

In this case, the two branches are spaced sufficiently to allow the wrist pin to pass between them as the crankshaft rotates. This embodiment allows the cam follower member to be balanced and the fact that there are two regions of contact with the crankshaft reduces the wear on the regions concerned.

As a preference in this case, the compressor piston is connected to said cam follower member practically at the middle of a base of said cam follower member connecting the two branches, so that an axis of said compressor piston is practically coplanar with an axis of the engine piston. This arrangement makes it possible to reduce the bulk of the engine equipped with the compressor by putting the engine cylinder and the compressor cylinder in one and the same plane orthogonal to the axis of rotation of the crankshaft, and angularly offset from one another, for example perpendicular to one another.

Advantageously, a crankcase, in which said crankshaft is mounted so that it can rotate, carries means for guiding said cam follower member in translation in an axial direction of the compressor cylinder.

As a preference, the compressor piston comprises a flexible sealed diaphragm, a peripheral edging of which is fixed in a sealed manner to a side wall of the compressor cylinder and at least one rigid plate fixed against a central part of said diaphragm, said at least one rigid plate being connected to said cam follower member so as to be driven back and forth with respect to the compressor cylinder, an intermediate part of said diaphragm located between said central part and said peripheral edging being able to deform as said at least one rigid plate moves.

According to one particular feature of the invention, the cam follower member is arranged between said compressor piston and said crankshaft, an elastic return means being arranged to return said compressor piston and said cam follower member toward said crankshaft.

As a preference, said elastic return means is a compressible spring arranged in said compression chamber and bearing on said compressor piston, or arranged between said cam follower member and a crankcase of said engine.

Advantageously, an abutment member is borne by a crankcase of said engine to stop said cam follower member at an abutment position during another part of said rotation cycle of the crankshaft in which said cam follower member is no more in contact with said cam profile.

Advantageously, the cam profile has an angular region which, when it collaborates with said cam follower member, brings said compressor piston into a position corresponding to the production of a boost pressure spike in said compression chamber, the angle of a dihedron, the vertex of which is formed by the axis of rotation of the crankshaft and the two half-planes of which extend one toward said wrist pin and the other toward said angular region of the cam profile, being calculated as a function of said predetermined operating speed and of a length of said inlet pipe so as to allow said boost pressure spike propagating through said inlet pipe between said compression chamber and said engine cylinder to reach said engine cylinder at practically the same time as said inlet member is shut off.

In general, the position at which the pressure spike is produced in the compression chamber lies in the compression stroke of the compressor piston and precedes its top dead center by an amount which depends in particular on the valves installed on the outlet side of said compression chamber. The result of this is that the angle of the dihedron, which is chosen so as to obtain the pressure spike in the engine cylinder at the time that the inlet member is shut off, can adopt numerous geometric values depending on the desired optimum operating speed, on the configuration of the inlet pipe, on the nature of the valves, etc.

According to another feature of the invention, said inlet member comprises at least one port arranged in a lower part of said engine cylinder so as to be uncovered by said engine piston when said engine piston is in a range around its bottom dead center, and to be shut off by said engine piston during the remainder of the cycle of said engine piston.

Alternatively, said inlet member comprises a controlled intake valve arranged at the top of said engine cylinder.

Advantageously, the predetermined operating speed corresponds to obtaining a maximum torque or a maximum mechanical power on the output shaft of said engine.

According to another group of embodiments of the invention, said coupling means comprises an eccentric mounted on the shaft of said crankshaft and a link rod articulated to the eccentric and coupled to the compressor piston.

As a preference in that case, the angle of a dihedron, the vertex of which is formed by the axis of rotation of the crankshaft and the two half-planes of which extend one toward the eccentric and the other toward the wrist pin is designed as a function of a length of said inlet pipe so as to obtain a phase shift between the top dead center positions of the engine and compressor pistons associated with the respective engine and compressor cylinders that are connected together by said inlet pipe, wherein said phase shift ensures that a supercharging pressure spike propagating through said inlet pipe between said compressor cylinder and said engine cylinder reaches said engine cylinder at substantially the same time as said inlet member is shut off when the engine operates at said predetermined speed.

Advantageously, the cylinder capacity of the compressor is of the order of magnitude of that of the cylinder, but with a compressor piston which has a diameter markedly greater than the diameter of the engine piston, so that the compressor piston has a short compression stroke in the compression chamber.

In a particular embodiment, the compressor piston is rigidly attached at its center to the link rod for connection with the eccentric so that the compressor piston moves in the compression chamber by rocking back and forth about lower and upper parts of the compression chamber, the axis of the compressor being offset, in the direction of the axis of the crankshaft, with respect to the axis of the cylinder. In this case, the compressor piston can have, at its periphery, a spherical edging fitted with a spherical sealing ring which is preferably unable to rotate with respect to the compressor piston, in a position such that the gap in the ring is not placed at the bottom of the compressor, so as to limit the oil consumption and therefore the environmental pollution.

In another embodiment, the compressor piston is secured at its center to a rod articulated to the link rod for connection to the eccentric, said rod being guided in translation in a direction which intersects the axis of the cylinder. In a first alternative form, the compressor piston is a deformable diaphragm connected at its periphery to the side wall of the compression chamber, said diaphragm preferably having an undulation at its periphery, to make it easier to deform. In a second alternative form, the compressor piston is a rigid cylinder which can move in axial translation and is fitted at its periphery with at least one sealing ring.

This other embodiment is advantageous in that it carries no risk of oil passing between the crankcase and the compression chamber of the compressor, because it is possible to arrange a seal or a sealing boot on the compressor piston rod.

In one particular embodiment, the compression chamber has two stages located one on each side of the compressor piston, a first stage being supplied with carburated mixture or with fresh air by a first nonreturn valve or a valve, and connected by a delivery duct fitted with a second nonreturn valve or a valve to the second stage which communicates with the cylinder via an inlet duct possibly fitted with a third nonreturn valve or a valve. The use of a two-stage compressor makes it possible to obtain a higher boost pressure in the cylinder. However, in this case, the volumetric ratio of the cylinder may be reduced so as not to reach a maximum combustion pressure which is incompatible with the mechanical strength of the cylinder. The engine equipped with this two-stage compressor will work in a similar way to the known hyperbaric-type supercharging system.

The two-stroke engine of the invention may also be fitted with a device for recovering the energy in the exhaust puffs and for partially recirculating the exhaust gases by providing an additional volume communicating with the engine cylinder through closure and opening means, the movements of which are controlled either in synchronism or with a phase shift with respect to those of the engine piston in the engine cylinder so that during the expansion phase, the burnt gases compress the air in the additional volume and at least partially enter it, so that this air and burnt gases mixture is trapped under pressure therein, and then so that this mixture is admitted into the engine cylinder during the compression phase.

Advantageously, after the air and burnt gases mixture previously trapped in the additional volume has been admitted into the engine cylinder, said additional volume is once again filled with fresh air from the compressor.

According to another feature, the aforementioned closure and opening means comprise two rotary shutters, for example multi-way rotary spools, connected to each other by the additional volume, one of the shutters being associated with the compressor, and the other shutter being associated with the exhaust from the engine cylinder.

As a preference, the two rotary shutters are arranged in such a way that the following operations take place: in a first phase, when the engine piston is near its TDC, a flow of air from the compressor passes through the lower shutter associated with the compressor, sweeps through the additional volume, passes through the upper shutter associated with the exhaust and is exhausted to the outside via an exhaust manifold; in a second phase, from about halfway through the expansion stroke of the engine piston, on the one hand, the upper shutter places the engine cylinder in communication with the additional volume so as to fill it with a pressurized mixture of air and burnt gases and, on the other hand, the engine cylinder communicates with the exhaust; in a third phase, the upper shutter traps the air and burnt gases mixture in the additional volume; in a fourth phase, air from the compressor is admitted into the engine cylinder and, in a fifth phase, at the start of the engine piston compression stroke, the trapped and pressurized mixture is admitted into the engine cylinder.

In a first alternative form, the upper shutter is associated with at least one exhaust valve located at the top of the engine cylinder and the lower shutter is connected to the engine cylinder by a pipe arranged toward the bottom of the cylinder so that the additional volume is pressurized via its upper end by the burnt gases from the exhaust valve through the upper shutter and is emptied into the engine cylinder via its lower end through the lower shutter.

In a second alternative form, the upper shutter is connected to the engine cylinder by a pipe arranged toward the bottom of the cylinder and the lower shutter is fitted on the delivery pipe between the two stages of the compressor so that the additional volume is pressurized by means of the burnt gases from the engine cylinder through the upper shutter and is emptied into the cylinder through the pipe connected to the upper shutter.

Advantageously, in the case of two-stroke or four-stroke engines, the inlet pipe to the engine cylinder and/or the delivery pipe from the two-stage compressor is cooled by any appropriate means.

The two-stroke engine may be of the loop scavenging type, in which the carburated mixture or the fresh air is admitted from the compressor through an inlet duct opening via ports into the lower part of the engine cylinder with an orientation such that the mixture or the air is introduced with a looping upward rotating movement, while the burnt gases from the previous cycle are discharged through exhaust ports also arranged toward the bottom of the cylinder.

The two-stroke engine may alternatively be of the uniflow type, in which the carburated mixture or the air is admitted toward the bottom of the engine cylinder through inlet ports distributed at the base of the engine cylinder and supplied by a ring, itself connected to the compressor, while the burnt gases from the previous cycle are discharged through one or more exhaust valves located at the top of the cylinder.

Finally, the two-stroke or four-stroke engine may be of the type with exhaust and inlet valves, in which the valves are located at the top of the engine cylinder and the inlet valve or valves are supplied by the compressor.

The invention is also applicable to an engine of the type with several in-line engine cylinders, in which the compressors associated with each engine cylinder are arranged alternately on each face of the crankcase.

BRIEF DESCRIPTION OF THE DRAWINGS

To allow better understanding of the subject matter of the invention, several embodiments thereof depicted in the appended drawing will now be described by way of purely illustrative and no limiting examples.

In this drawing:

FIG. 1 is a diagrammatic view in vertical section of a first embodiment of the engine of the invention, of the two-stroke loop-scavenging type with a single-stage compressor and a rocking compressor piston, with a partial enlargement of the latter in FIG. 1A;

FIGS. 2A to 2D are part views similar to FIG. 1 and in vertical section on the line II of FIG. 3, respectively depicting the engine piston at its TDC, during expansion, at its BDC and during compression, in the case of a two-stroke engine;

FIG. 3 is a view in section on the line III of FIG. 2A;

FIG. 4 is a view similar to FIG. 1, but according to an alternative form in which the compressor piston is of the linear displacement type, with a partial enlargement of the latter in FIG. 4A;

FIGS. 5A to 5D are views similar to FIGS. 2A to 2D and in vertical section on the line V of FIG. 6A, but depicting another alternative form in which the compressor piston is a deformable diaphragm and the engine cylinder is equipped with a spark plug;

FIGS. 6A to 6D are views in section on the line VI of FIGS. 5A to 5D respectively, with a partial enlargement of said diaphragm in FIG. 6E;

DETAILED DESCRIPTION OF THE INVENTION

Figure 5C:
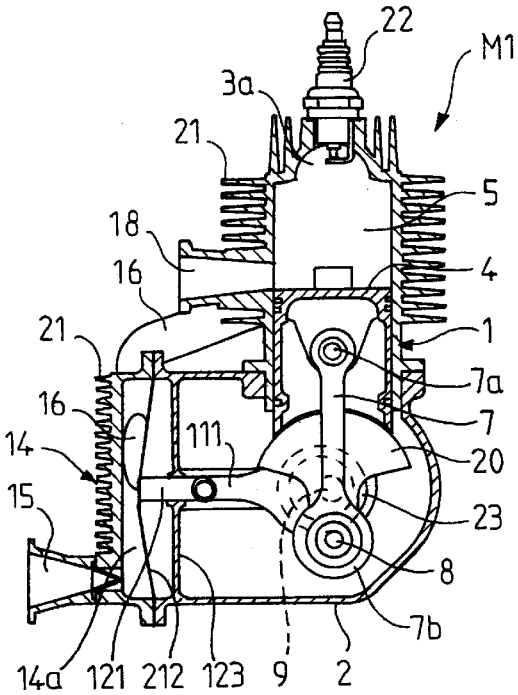

For reasons of clarity, elements which are identical or similar will carry the same reference numerals in all the figures.

FIGS. 1 to 9 depict various alternative forms of the invention applied to a two-stroke single-cylinder internal combustion engine M1 with loop scavenging.

In the first alternative form depicted in FIGS. 1 to 3, the engine M1 has a cylinder 1 defined between the crankcase 2 and the cylinder head 3 of the engine. The cylinder head 3 has a recess 3*a* toward the top of the cylinder 1 to define a combustion chamber, because the proposed depiction is that of a petrol engine. The invention may just as easily be applied to a direct-injection or indirect-injection diesel engine.

An engine piston 4 which defines a combustion chamber 5 inside the cylinder 1 between the cylinder head 3 and the piston 4 executes a reciprocating movement inside the cylinder 1. The engine piston 4 is fitted at its periphery with sealing rings 6 depicted in FIG. 1. A connecting rod 7 is articulated by its small end 7*a* to the piston 4 and by its big end 7*b* to the wrist pin 8 of a crankshaft 9.

An eccentric 10 is mounted on the shaft of the crankshaft 9 and articulated to a link rod 11 which is rigidly attached to the center of a disk-shaped compressor piston 12. The compressor piston 12 has, at its periphery, a spherical edging 12*a* fitted with a sealing ring 13 the edging of which is also spherical, which is prevented from rotating with respect to the compressor piston, in a position such that the gap in the ring 13 is not placed at the bottom of the crankcase 2 as visible in FIG. 1A. The compressor piston 12 rocks back and forth inside the compression chamber 14*a* of a single-stage compressor 14 attached to the crankcase 2. The compression chamber 14*a* of the compressor 14 is supplied with carburated mixture or with fresh air by an intake pipe 15 or is fitted with a nonreturn intake valve 15*a*. The carburated mixture or the fresh air under pressure is delivered from the compressor 14 to an inlet pipe 16 fitted with a nonreturn delivery valve 16*a*. The inlet pipe 16 opens toward the bottom of the cylinder 1 via a number of ports 17 orientated such that the pressurized mixture or air is introduced with an upward looping rotational movement into the cylinder in the manner of a loop-the-loop. The cylinder 1 is further equipped with one or more exhaust ducts 18 which open toward the bottom of the cylinder, at roughly the same level as the intake ports 17.

As visible in FIG. 1, the eccentric 10 is offset by an angle θ of the order of 90° with respect to the crank wrist 8, in the direction of rotation of the crankshaft, as indicated by the arrow F, so that the TDC of the engine piston 4 is phase-shifted by 180° from the TDC of the compressor piston 12. Referring to FIG. 3, it may be seen that the axis of the link rod 11 of the compressor 14 is offset by a distance d from the axis of the connecting rod 7 of the engine piston 4.

The cylinder capacity of the cylinder 1 is roughly of the same order of magnitude as the cylinder capacity of the compressor 14, but the compressor piston 12 has a diameter markedly greater than that of the engine piston 4, so that the compression stroke c of the compressor piston 12 is relatively short.

Finally, the inlet pipe 16 may be fitted with a heat exchanger 19, carrying a coolant, for example water, or alternatively fresh air may be blown through in the case of an air-cooled engine, to cool the air leaving the compressor 14, thus making it possible to increase the mass of air admitted into the cylinder 1, especially since compressing the air in the compressor 14 gives off a large amount of heat. However, cooling the inlet pipe 16 is optional.

Referring now to FIGS. 2 and 3 it can be seen that the wrist pin 8 of the crankshaft 9 is fitted, at the opposite end to the big end of the connecting rod 7*b*, with a flyweight 20 which acts as a counterweight.

The positions of the TDC and BDC of the engine piston 4 have been marked in FIG. 1 using broken line.

The path of the eccentric 10 and the path of the wrist pin 8 have also been marked in FIG. 1, in chain line.

The way in which this engine works will now be described with reference to FIGS. 2A to 2D.

In FIG. 2A, the engine piston is at the end of compression, at its TDC, while the compressor piston 12 is at its BDC, that is to say in its position furthest to the right in FIG. 2A. During expansion, under the action of the combustion of the gases in the combustion chamber 5, the engine piston effects a downstroke, as illustrated in FIG. 2B, once the crankshaft 9 has rotated through about 90°, and this simultaneously causes the compressor piston 12 to rock about its upper portion, thus performing a first compression in the compression chamber 14*a*. At the end of expansion, the engine piston 4 reaches its BDC, simultaneously uncovering the exhaust duct 18 and the inlet ports 17, after an additional rotation of the crankshaft 9 through 90°. At the same time, the compressor piston 12 rocks about its lower portion to reach its position of maximum compression furthest to the left in the compression chamber 14*a*, which causes the pressurized air or carburated mixture to be admitted into the combustion chamber 5, thus driving the burnt gases toward the exhaust and filling the cylinder. FIG. 2D depicts the engine piston during its compression phase, after an additional rotation of the crankshaft through 90°, and this simultaneously closes the exhaust and the inlet and causes the compressor piston 12 to rock about its upper portion, and thus allow a first expansion of the compression chamber 14*a*, the fresh air or the carburated mixture being drawn in through the intake pipe 15 because of the depression thus generated in the chamber 14*a*. Finally, when the engine piston 14 reaches its TDC illustrated in FIG. 2A, after an additional rotation of the crankshaft 9 through 90°, the compressor piston 12 rocks about its lower portion to return to its position furthest to the right, the fresh air or the carburated mixture continuing to be thus drawn into the compression chamber 14*a*. The running cycle which has just been described is thus repeated over and over again.

As visible in FIGS. 2A to 2D. the eccentric 10 is formed of a disk mounted eccentrically on the shaft of the crankshaft 9.

However, because of the back and forth rocking of the compressor piston 12, there is the risk that the oil contained in the crankcase might pass into the compression chamber 14*a*, causing oil to be consumed and causing pollution of the environment because the oil is thus discharged to the outside.

This drawback is prevented in the alternative form illustrated in FIGS. 4 to 7, in which the rocking compressor piston 12 is replaced by a compressor piston 112 illustrated in FIG. 4 which reciprocates back and forth in linear translation in the compression chamber 14*a*.

At its periphery this compressor piston 112 also has a sealing ring and at its center has a rod 121 rigidly attached to the compressor piston 112 and articulated at its free end to the link rod 11 for connecting with the eccentric 10. The rod 121 is guided in translation by a guide sleeve 122 which is connected to the crankcase 2 via a vertical partition 123. The sleeve 122 may be fitted internally with a sealing ring through which the rod 2.21 passes, or alternatively a sealing boot S may be connected between the rod 121 and said vertical partition 123, eliminating any risk of oil passing between the crankcase and the compressor as visible in FIG. 4A.

Figure 5D:
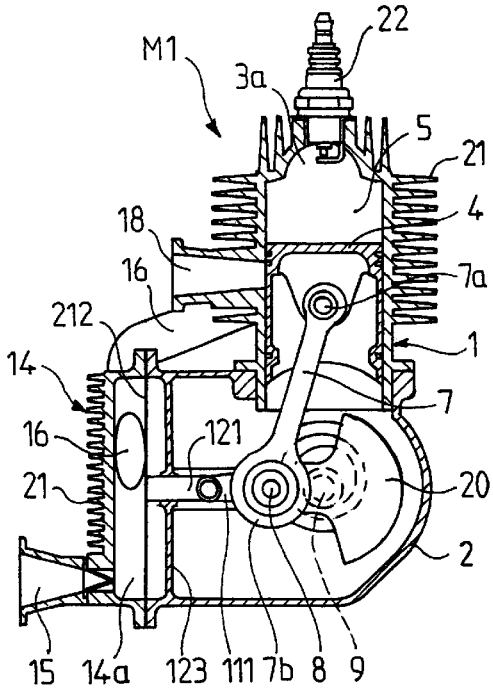
Figure 6C:
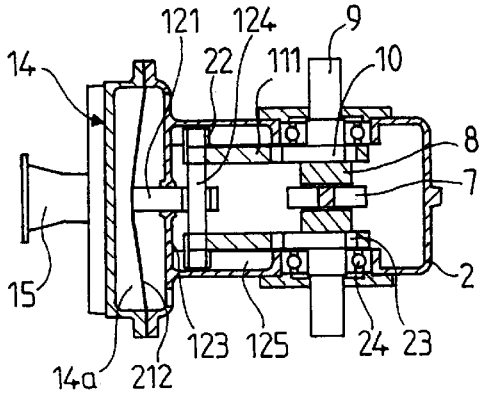
Figure 6D:
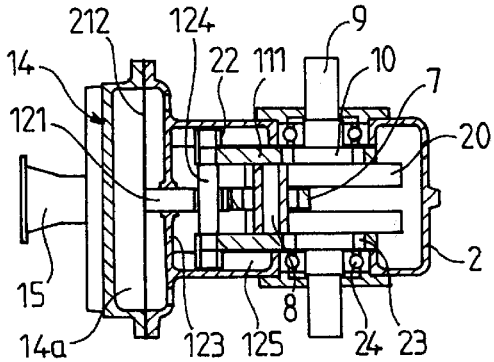
Figure 7:
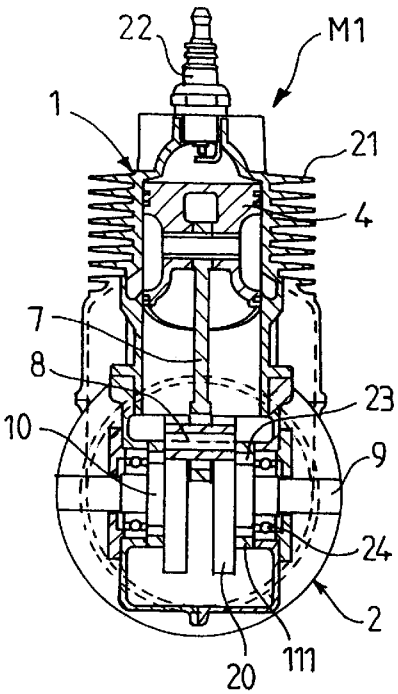
FIG. 7 is a view in section on the line VII of FIG. 5A.

In FIGS. 5 to 7 it can be seen that the cylinder 1 and the compressor 14 are fitted with cooling fins 21.

Arranged at the top of the cylinder 1 is a spark plug 22.

The engine M1 here consists of a first unit which forms the cylinder 1, a second unit which forms the crankcase 2 and a third unit which forms the compressor 14. Thus the compressor piston 112 in the form of a rigid disk may be replaced by a deformable diaphragm 212, the periphery of which is fixed between the aforementioned second and third units. To make the diaphragm 212 easier to deform, an undulation 212*a* may be provided near its periphery, as visible in FIG. 6E.

As best visible in FIGS. 6A to 6D, the rod 121 connects the center of the deformable diaphragm 212 to an articulated crossmember 124, the free ends of which slide in a groove 125 made in the crankcase 2 and are each connected to two arms 111 which extend on both sides of the axis of the compressor 14. The link rod for connection to the eccentric is thus formed by the assembly comprising the crossmember 124 and the two arms 111. The two arms 111 of the link rod are each mounted on a disk 10 which is mounted respectively and eccentrically on the shaft 9 of the crankshaft between the side wall of the crankcase 2 and a web of the wrist pin 8. Needle bearings 22 to 24 are provided at the free ends of the crossmember 124 between each link rod arm 111 and the eccentric disk 10, and at the shaft of the crankshaft 9, respectively. However, if the rotation is slow enough, these bearings could be replaced by ball bearings or by journal bearings.

As visible in FIG. 7, in this case the axis of the compressor piston is centered on the axis of the engine piston, unlike the rocking compressor piston alternative form of FIGS. 1 to 3.

The operating cycle of this engine, the compressor piston of which is mounted using a crosshead link, is essentially the same as that of the rocking-piston engine. As the crankshaft 9 rotates, the crossmember 124 moves in a straight translation motion in the grooves 125, which causes the rod 121 to move and this causes the diaphragm 212 to deform. In FIG. 5A, the engine piston 4 is at its TDC, and the diaphragm is deformed in bending to the right toward the crankshaft. In FIG. 5B, the engine piston is halfway through its stroke in the expansion phase, and the diaphragm 212 is in an essentially flat vertical position. In FIG. 5C, the engine piston 4 is at its BDC. and the diaphragm 212 is deformed in bending to the left, away from the crankshaft. Finally, in FIG. 5, the engine piston 4 is halfway through its compression upstroke and the diaphragm 212 is once again in a flat position, at rest.

By way of example, the engine depicted in FIGS. 5 to 7, has one cylinder 1 with a diameter of about 42 mm and a working stroke of 38 mm for the engine piston 4, and a compressor 14 with a diameter of 80 mm and a working stroke of about 8.5 mm in the case of the compressor piston 212.

Figure 8:
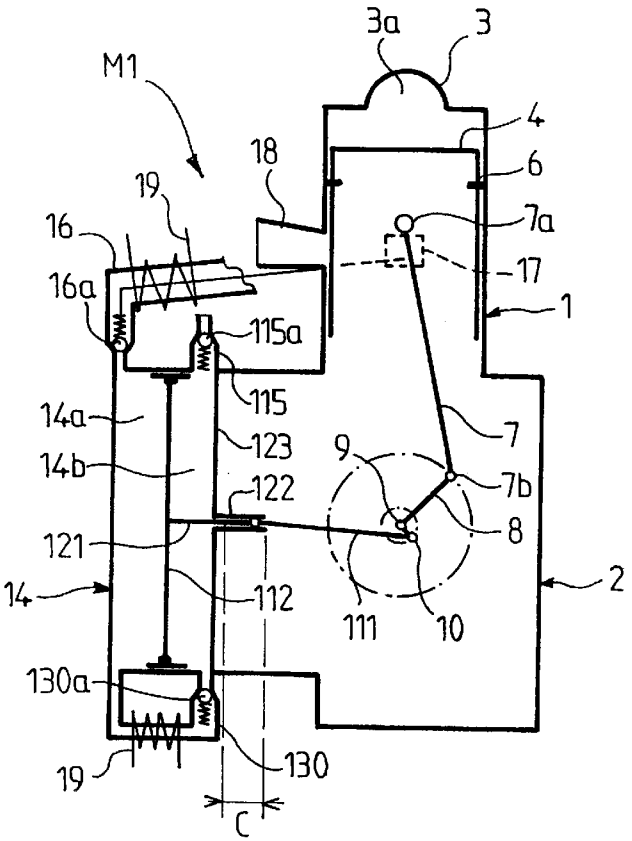
FIG. 8 is a view similar to FIG. 4 but depicting a two-stroke engine with a two-stage compressor.

The alternative form illustrated in FIG. 8 differs from the alternative form depicted in FIG. 4 essentially in the fact that the compressor 14 comprises a compression chamber with two stages 14*a* and 14*b*. The first stage 14*b* is formed between the partition 123 and the compressor piston 112, while the second stage 14*a* is formed on the other side of the compressor piston 112. The first stage 14*b* at the top has an intake duct 115 fitted with a nonreturn valve 115*a*. This first stage 14*b* has the piston rod 121 of the compressor 112 passing through it. Toward the bottom of the first stage 14*b* there is an intermediate delivery pipe 130 which communicates toward the bottom with the second stage 14*a* of the compressor 14. This intermediate delivery pipe 130 is fitted with a nonreturn valve 130*a* and with a cooling system 19. The second stage 14*a* of the compressor 14 communicates toward the top with the inlet duct 16, in a similar way to the single-stage compressor described in FIGS. 1 to 7.

The various valves 115*a*, 130*a* and 16*a* of the compressor 14 and the valves 118*a* and 217 of the engine may advantageously be replaced by mechanically or electronically or hydro-electronically controlled valves which can be managed by a digital computer, so as to control all the engine parameters to order, namely the compression ratio in the compressor and/or in the engine cylinder, and the expansion ratios.

Although FIG. 8 depicts a compressor piston 112 in the form of a rigid flat disk, it could just as well be replaced by a deformable diaphragm similar to the one depicted in FIGS. 5 and 6.

During the compression phase of the engine piston 4, the compressor piston 112 moves to the right, to compress the first stage 14*b* of the compression chamber, which causes air to be delivered, via the pipe 130, to the second stage 14*a*. During the expansion downstroke of the engine piston 4, the compressor piston 112 moves to the left, which causes the air contained in the second stage 14*a* to be compressed further, it not being possible for the air to retreat backward through the pipe 130 because of the nonreturn valve 130*a*, and this air therefore escapes to the inlet pipe 16 at a pressure higher than the pressure which would be obtained with a single-stage compressor. At the same time, a depression is caused in the first stage 14*b*, and this causes air to be drawn in from the intake duct 115.

In FIG. 8, the stroke of the compressor piston 112 is depicted c.

Figure 9:
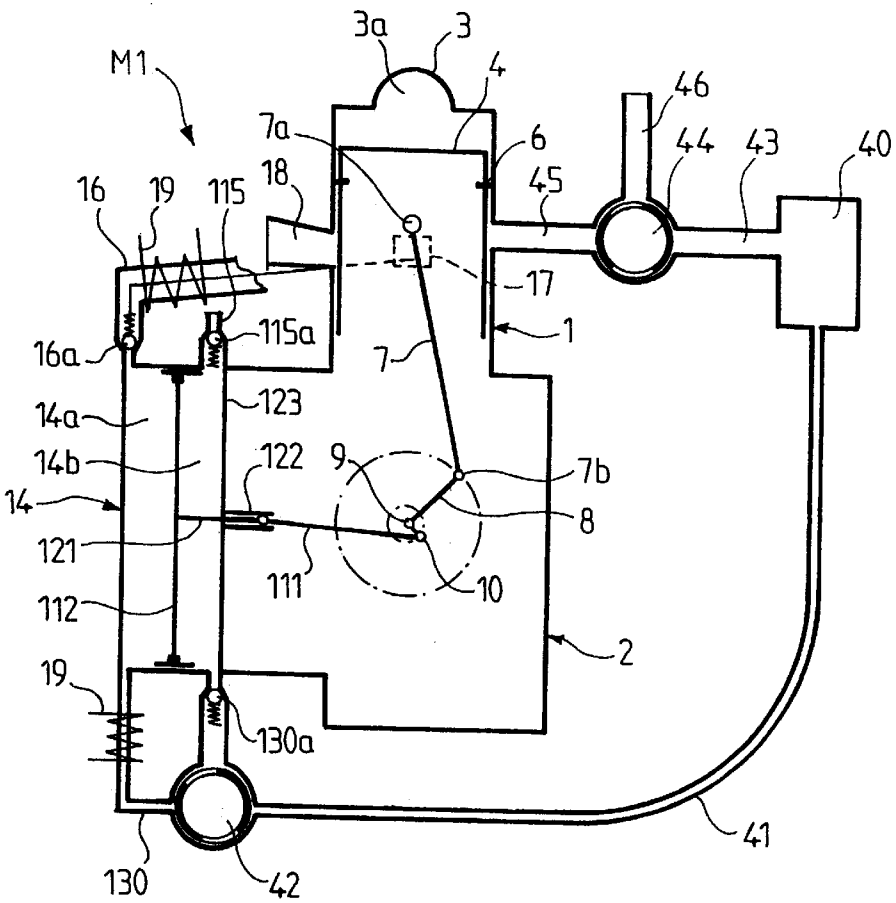
FIG. 9 is a view similar to FIG. 8 but depicting the two-stroke engine further equipped with a system for partially recirculating the exhaust gases.

In FIG. 9, the engine of FIG. 8 is fitted with a device for recovering energy from the exhaust puffs and for partially recirculating the exhaust gases, the principle of which is described in detail in French patent application No. 98-07835 of Jun. 22, 1998, belonging to the current applicant.

An additional volume 40, which may have any appropriate shape, communicates toward the bottom with a pipe 41 which opens to a rotary shutter 42, for example a three-way rotary spool which is fitted in the aforementioned delivery pipe 130 downstream of the valve 130*a*. The additional volume 40 also communicates, toward the top, with a pipe 43 which opens to a second, upper, rotary shutter 44, for example a three-way rotary spool, the latter communicating, on the one hand, via a pipe 45 toward the bottom of the cylinder 1, and, on the other hand, via a pipe 46, with an exhaust manifold (not depicted) connected to the aforementioned exhaust duct 18.

The way in which the engine illustrated in FIG. 9 works will now be described.

When the engine piston 4 comes close to its TDC, during the compression phase, the lower spool 42 causes the first stage 14*b* of the compressor 14 to communicate with the pipe 41, while at the same time shutting the passage to the second stage 14*a*, while the upper spool 44 causes the pipe 43 to communicate with the exhaust pipe 46, while at the same time shutting the passage to the pipe 45 which opens toward the bottom of the cylinder 1. As a result, the air compressed by the compressor piston 112 in the first stage 14*b* is discharged to the exhaust, sweeping the additional volume 40, the remainder of the air and burnt gases mixture in this volume 40 thus being discharged to the outside and replaced with fresh air.

Next, at the start of the expansion phase of the engine piston 4, this phase being depicted in FIG. 9, the spools 42 and 44 shut off any communication, it being possible for the rotation of the spools to be slaved to the rotation of the crankshaft 9, or alternatively controlled by a central electronic management unit.

When the engine piston 4 has practically reached the end of its expansion stroke, the engine piston 4 uncovers the opening of the pipe 45 and the combustion gases under pressure in the cylinder 1 then escape through this pipe 45 and pass through the shutter 44 as far as an additional volume 40, the upper shutter 44 being in a position of shutting off the exhaust pipe 46. At the same time, the shutter 42 closes the passage of the pipe 41, so that the burnt gases compress the air in the additional volume 40 and partially penetrate it.

At the same time as, or shortly after the opening of the pipe 45, the engine piston 4 also uncovers the exhaust duct 18, to discharge the remainder of the burnt gases, which are driven out by the pressurized fresh air introduced through the inlet ports 17 from the second stage 14*a* of the compressor, under the compression action exerted by the compressor piston 112 moving to the left. When the engine piston 4 reaches its BDC, the upper spool 44 shuts off any communication, and the lower spool 42 opens the passage between the first and second stage of the compressor, while keeping the passage to the pipe 41 closed, so that the pressurized air and burnt gases mixture which was in the additional volume 40, is thus trapped therein. At BDC, scavenging in the cylinder 1 stops and the cylinder begins to fill with fresh air at high pressure delivered by the compressor 14.

When the compression phase in the cylinder begins, the compressor piston 112 delivers the compressed air in the first stage 14*b* to the second stage 14*a* through the lower spool 42 which keeps the communication of the pipe 130 open while at the same time keeping the passage to the pipe 41 closed. At the same time, the upper spool 44 opens the passage between the additional volume 40 and the cylinder 1, keeping the passage to the exhaust pipe 46 closed, so that the air and burnt gases mixture trapped in the volume 40 can escape through the pipes 43 and 45 into the cylinder 1, which simultaneously supercharges the cylinder 1 and allows energy to be recovered from the exhaust puffs.

When the engine piston 4 has covered more than about half of its upstroke, the exhaust duct 18 and the pipe 45 are shut off by the engine piston 4 and the spools 44 and 42 gradually move toward the position which places the first stage 14*b* of the compressor in communication with the exhaust 46.

It will be noted that in this case the two-stage compressor 14 has a lower efficiency than was the case in FIG. 8. because some of the compression stroke of the first stage 14*b* of the compressor 14 is used to sweep the additional volume 40.

The application of the invention to a two-stroke single-cylinder engine of the uniflow type M2 will now be described with reference to FIGS. 10 to 13.

Figure 11:
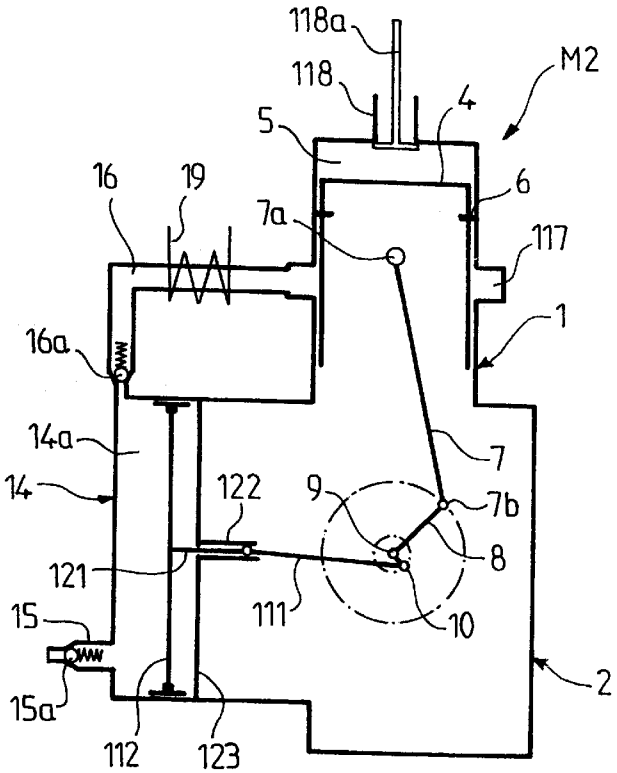
FIGS. 10 and 11 are views respectively similar to FIGS. 1 and 4 but depicting a second embodiment of the two-stroke engine of the invention of the uniflow type.
Figure 10:
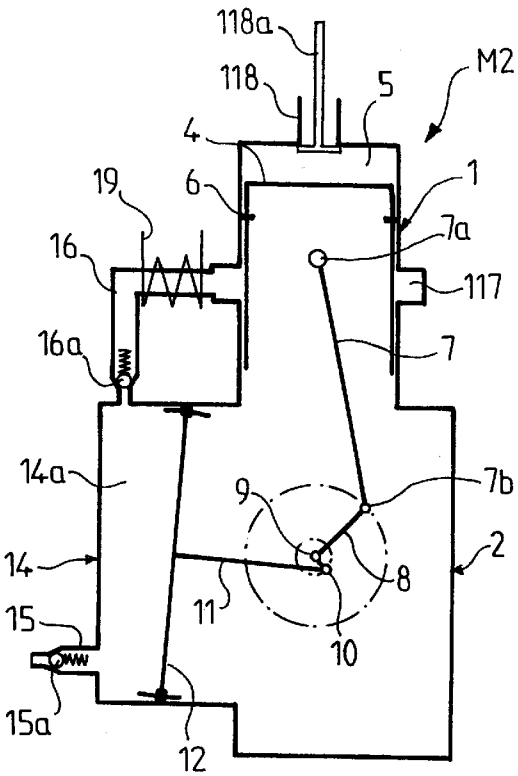
Figure 12:
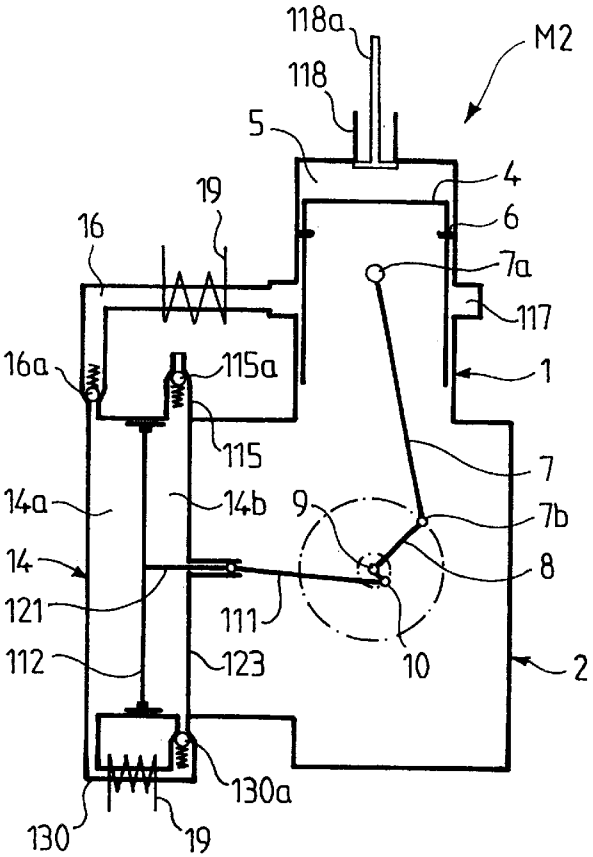
FIG. 12 is a view similar to FIG. 11 but depicting the two-stroke engine equipped with a two-stage compressor.

The three alternative forms depicted in FIGS. 10 to 12 respectively correspond to the alternative forms depicted in FIGS. 1, 4 and 8 of the loop-scavenging engine. This being the case, the operation of the uniflow engine M2 will be described just once to cover all of these three alternative forms.

In a uniflow engine as depicted in FIG. 10, the inlet pipe 16 opens to an annular ring 117 surrounding the bottom of the cylinder 1, said ring 117 having a number of ports (not depicted) which open toward the bottom of the cylinder 1 with an orientation such that the air is introduced into the cylinder with a great deal of rotational movement. The exhaust pipe 118 is at the top of the cylinder 1 and has at least one valve 118*a* which is controlled by any appropriate means.

When the engine piston 4 is at its TDC, the exhaust valve or valves 118*a* are closed, as are the inlet ports which are blocked by the body of the engine piston 4. At the end of the expansion phase of the engine piston 4, the exhaust valve or valves 118*a* open(s) to discharge the burnt gases, and the engine piston 4 uncovers the ports of the inlet ring 117, so that the compressed air from the compressor 14 drives the burnt gases upward toward the exhaust. The filling of the cylinder 1 with oxidizing air continues until the start of the compression phase of the engine piston 4, as long as the inlet ports remain uncovered by the engine piston 4.

Figure 13:
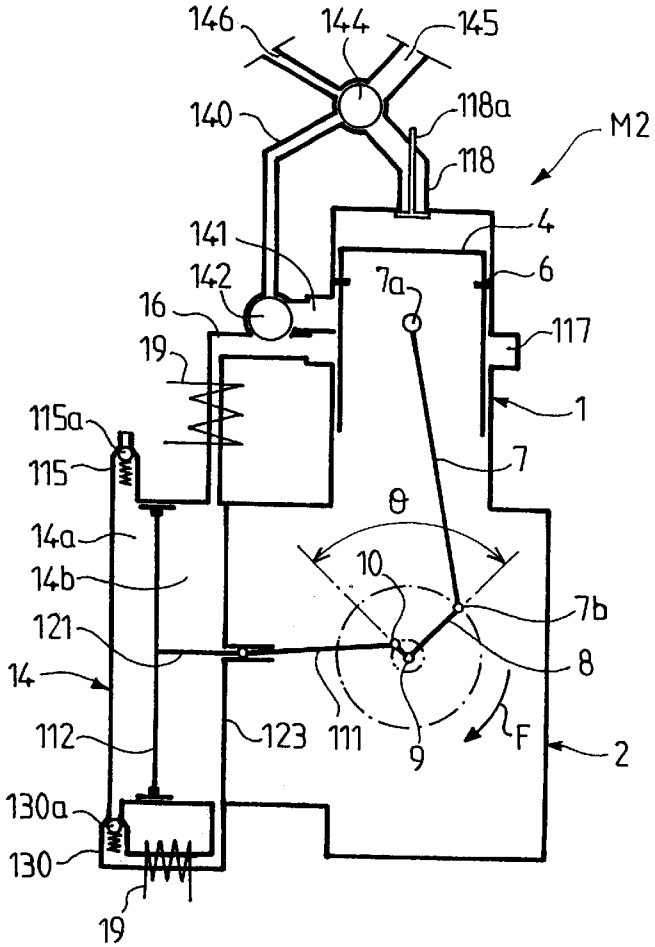
FIG. 13 is a view similar to FIG. 12 but depicting the two-stroke engine further equipped with a system for recovering the energy in the exhaust puffs.

In the alternative form of FIG. 13, the engine M2 is also fitted with a device for recovering the energy in the exhaust puffs and for partially recycling the exhaust gases. This device comprises an additional volume 140 which is formed by a pipe of appropriate cross section communicating at its two ends with a rotary shutter 142, 144 which may consist of a multi-way rotary spool. The upper spool 144 also communicates with the exhaust pipe 118, downstream of the exhaust valve or valves 118*a* provided at the top of the cylinder 1, and with two other pipes 145 and 146 which end at an exhaust manifold, not depicted.

The lower spool 142 further communicates with a pipe 141 which opens toward the bottom of the cylinder 1, above the inlet ring 117, and with the inlet pipe 16.

The rotary movements of the spools 142, 144 are connected in any appropriate ways known to the person skilled in the art and therefore not described, to the rotary movement of the crankshaft 9, in a 1/1 ratio or a ratio different from 1/1, which may be in-phase or phase-shiftable with or with respect to the movement of the crankshaft.

Furthermore, in FIG. 13, the positions of the two stages 14*a* and 14*b* of the compressor 14 are reversed with respect to the compressor piston 112. Specifically, the inlet pipe 16 communicates with the stage 14*b* located between the compressor piston 112 and the vertical wall 123, while the first stage 14*a* on the opposite side of the compressor piston 112 to the crankshaft 9 is supplied with fresh air via the intake pipe 115. Thus, the operation of the compressor 14 is reversed, and the wrist pin 8 of the crankshaft has to be phase shifted with respect to the eccentric 10 in the direction of rotation F of the crankshaft 9, for example by an angle θ of about 90°.

When the engine piston 4 is at its TDC, any exhaust valve or valves 118*a* provided are closed as are the spools 142 and 144.

During the expansion phase of the engine piston 4, the exhaust valve or valves 118*a* open(s) and the upper shutter 144 pivots, for example in the same direction as the crankshaft 9, to cause the exhaust pipe 118 to communicate with the pipe 140 forming the additional volume. The lower spool 142 has also rotated by the same amount in the same direction, but this has not caused pipes to communicate. The result of this is that a puff of pressurized burnt gases is discharged by the exhaust pipe 118 into the pipe 140, and this compresses the air therein while at the same time introducing a portion of burnt gases into it, corresponding to the angular transfer period.

When the engine piston 4 reaches an intermediate position between the pipe 141 and the inlet ring 117, the exhaust valve or valves 118*a* are still open but the spool 114 which has rotated places the pipes 118 and 145 in communication while at the same time closing the passage to the pipe 140; the lower spool 142 has also rotated, but without causing communication. What this means is that the air/burnt gases mixture which was previously introduced under pressure (about 3.5 bar at full load) into the pipe 140 is trapped therein and the burnt gases escape through the pipe 145 to the exhaust manifold.

When the engine piston 4 reaches its BDC, the upper shutter 144, although it has continued to rotate, maintains the communication between the pipes 118 and 145; the lower shutter 142 has also rotated, but without causing communication; the ports of the inlet ring 117 are uncovered. What this means is that air from the stage 14*b* of the compressor 14 performs scavenging which removes the burnt gases through the exhaust valve or valves 118*a* and the cylinder 1 fills with air with the relatively high pressure of the compressor 14. The air/burnt gases mixture is still trapped under pressure in the pipe 140.

When the engine piston 4 begins its compression phase, it closes off the ports of the inlet ring 117 and lies flush with the level of the pipe 141; as the shutter 142 has continued to rotate, the pipes 118 and 145 can still communicate, but this has no effect because the exhaust valve or valves 118*a* have closed again; the lower spool 142 places the pipe 141 in communication with the pipe 140. As a result, the air/burnt gases mixture which was trapped under pressure in this pipe 140 escapes and, under pressure, fills the cylinder 1. This simultaneously supercharges the cylinder and partially recirculates the burnt gases, an operation known by the name of EGR (Exhaust Gas Recirculation), and has the effect of reducing the nitrogen oxides emissions at low speed.

When the engine piston 4 continues its compression, until it shuts off the pipe 141, the exhaust valve or valves 118*a* remain closed, and the spools 142, 144 pivot into a position in which all communication is prevented.

When the engine piston 4 essentially reaches the end of the compression stroke, the exhaust valve or valves 118*a* remain closed, but the upper spool 114 places the pipe 140 in communication with the pipe 146; the lower spool 142 places the pipe 140 in communication with the inlet pipe 16. As a result, the fresh air from the compressor 14 flows through the pipes 16, 140 and 146 to discharge the residual air/burnt gases mixture in the pipe 140 to the outside.

When the engine piston reaches TDC, the cycle is ready to recommence.

Figure 14:
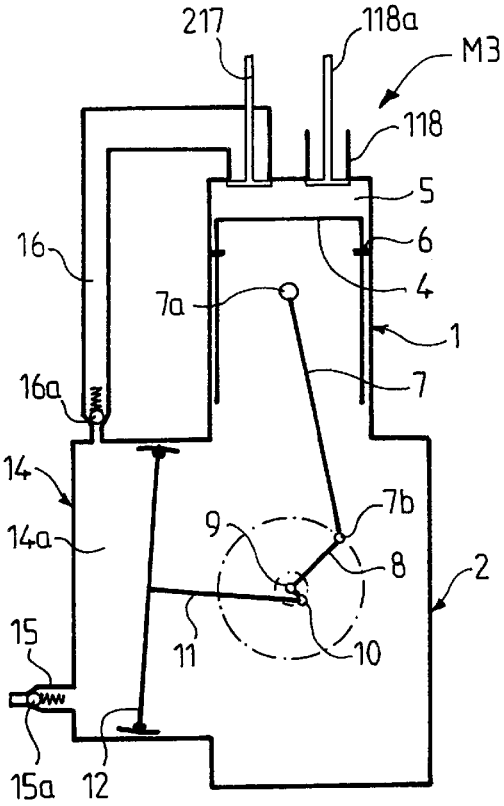
FIGS. 14 and 15 are views similar to FIGS. 1 and 4 respectively but depicting a third embodiment of the two-stroke engine of the invention, of the type with exhaust and inlet valves.
Figure 15:
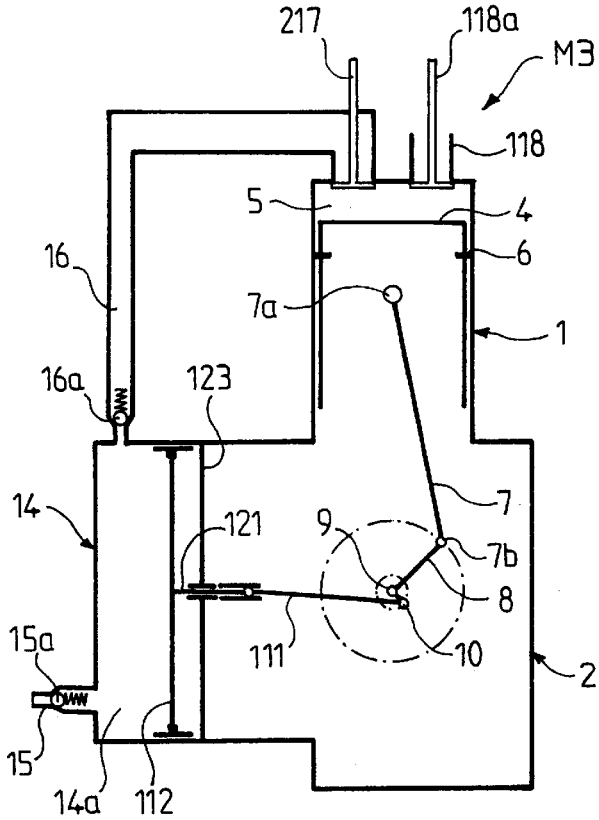

FIGS. 14 and 15 depict the application of the invention to an engine M3 of the two-stroke single-cylinder type with inlet and exhaust valves.

FIGS. 14 and 15 depict two alternative forms which correspond to the alternative forms of FIGS. 10 and 11 of the engine M2 of the uniflow type.

The only difference common to both alternative forms lies in the fact that the inlet pipe 16 opens at the top of the cylinder 1 where there are one or more inlet valves 217. The operation of this type of engine is similar to the previous types of operation.

Although the two alternative forms of FIGS. 14 and 15 contain a single-stage compressor, it would also be possible to envisage a two-stage compressor (see the engine of the type depicted in FIG. 17) and/or a device for partially recirculating the exhaust gases, without departing from the scope of the invention.

Figure 17:
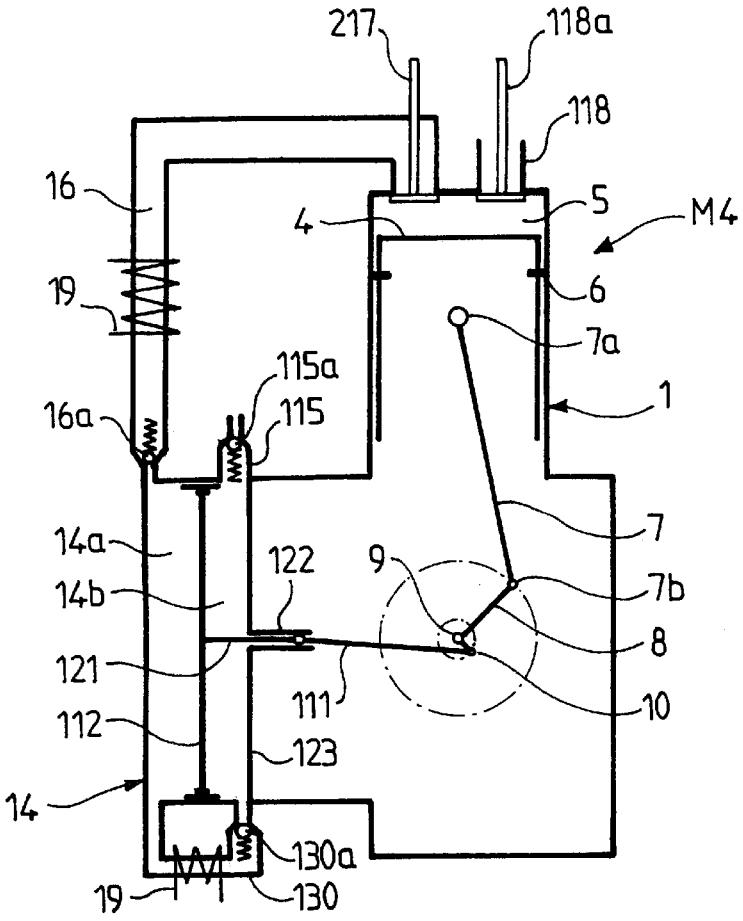
FIG. 17 is a view similar to FIG. 15 but depicting a four-stroke engine equipped with a two-stage compressor.

FIG. 17 depicts an engine M4 with a two-stage compressor which can be used just as easily for a two-stroke engine or a four-stroke engine. The components of this engine M4 which are identical to those of the engines described earlier bear the same reference numerals.

FIGS. 18 to 25 depict the various phases of the operating cycle of a four-stroke engine M4 of the type with exhaust and inlet valves and a single-stage compressor containing a rocking compressor piston. Of course, the engine M4 could have one or more cylinders. The way in which the four-stroke engine works will now be described with reference to FIGS. 18 to 25.

Figure 18:
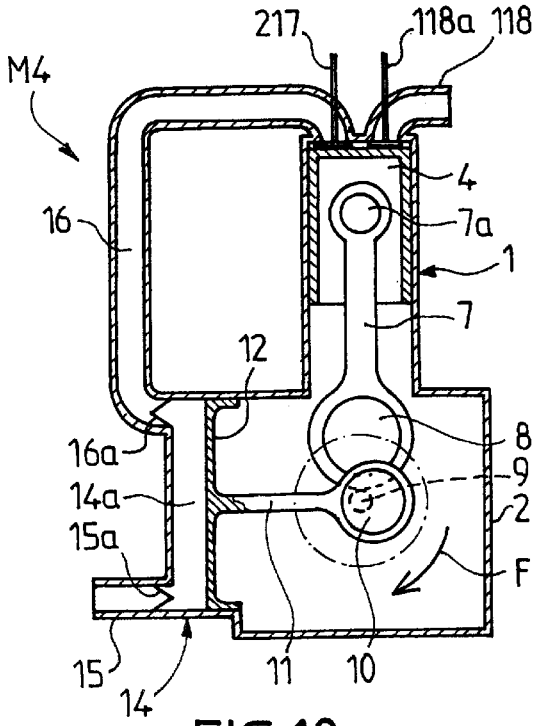
FIGS. 18 to 25 are part views in section similar to FIG. 14 depicting a four-stroke engine during the various successive phases of its cycle.

In FIG. 18, the engine piston 4 is at the end of its compression stroke, at its TDC, while the compressor piston 14 is at its BDC, that is to say in the position furthest to the right in FIG. 18. In this position, the inlet valve 217 and the exhaust valve 118*a* are closed, as is the inlet valve 15*a* and the delivery valve 16*a*. The position illustrated in FIG. 18 corresponds to ignition of the carburated mixture in the combustion chamber.

For example, the angular phase shift between the wrist pin 8 and the eccentric 10 is of the order of 90°. However, this phase shift is more precisely calculated according to constructional and functional parameters, such as the efficiency of the compressor and the cylinder filling ratio, so that, at a synchronized operating speed ω, which is the speed for which maximum torque or mechanical power is to be obtained on the engine output shaft, the peak of a pressure wave propagating from the compressor 14 reaches the cylinder 1 at practically the same instant as the inlet valve 217 is shut off. This function will be explained in further detail with reference to the engine M6.

For the position illustrated in FIG. 18, the chamber 14*a* of the compressor 14 is filled with fresh air, while the inlet pipe is filled with compressed hot air.

Figure 19:
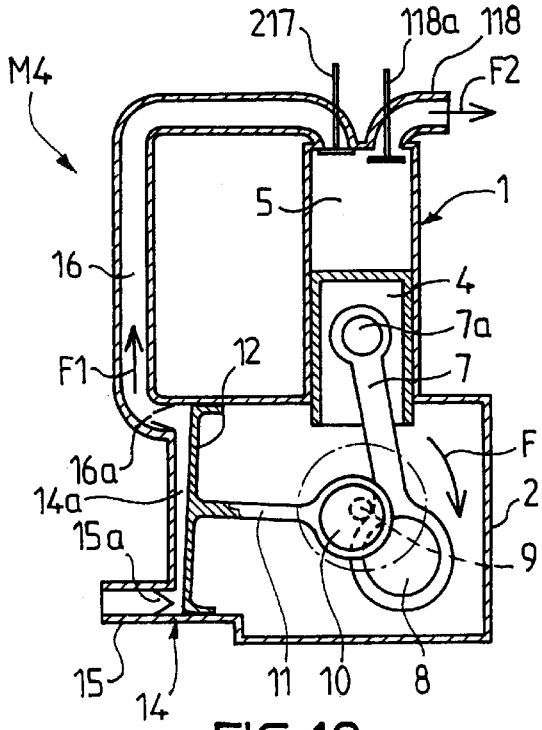

During expansion, under the action of the combustion of the gases in the combustion chamber 5, the engine piston makes a downstroke, as illustrated in FIG. 19, after the crankshaft 9 has rotated through about 150°, this simultaneously causing the compressor piston 12 to rock about its upper portion, and then start to rock about its lower portion, thus performing a first compression in the compressor chamber 14*a*.

As illustrated in FIG. 18, the crankshaft 9 rotates in the clockwise direction illustrated by the arrow F.

In the position illustrated in FIG. 19, the combustion chamber 5 is full of burnt gases which begin to be exhausted through the exhaust duct 118, as illustrated by the arrow F2, following the opening of the exhaust valve 118*a* which moves into its lower position as illustrated in FIG. 19. The inlet valve 15*a* remains closed, but the delivery valve 16*a* opens, which allows the compressed air in the compressor chamber 14*a* to be delivered to the inlet pipe 16 which already contains some compressed air. Thus, further-compressed air is obtained in the inlet pipe 16, as illustrated by the arrow F1.

Figures 20, 21, 22, 23, 24, 25:
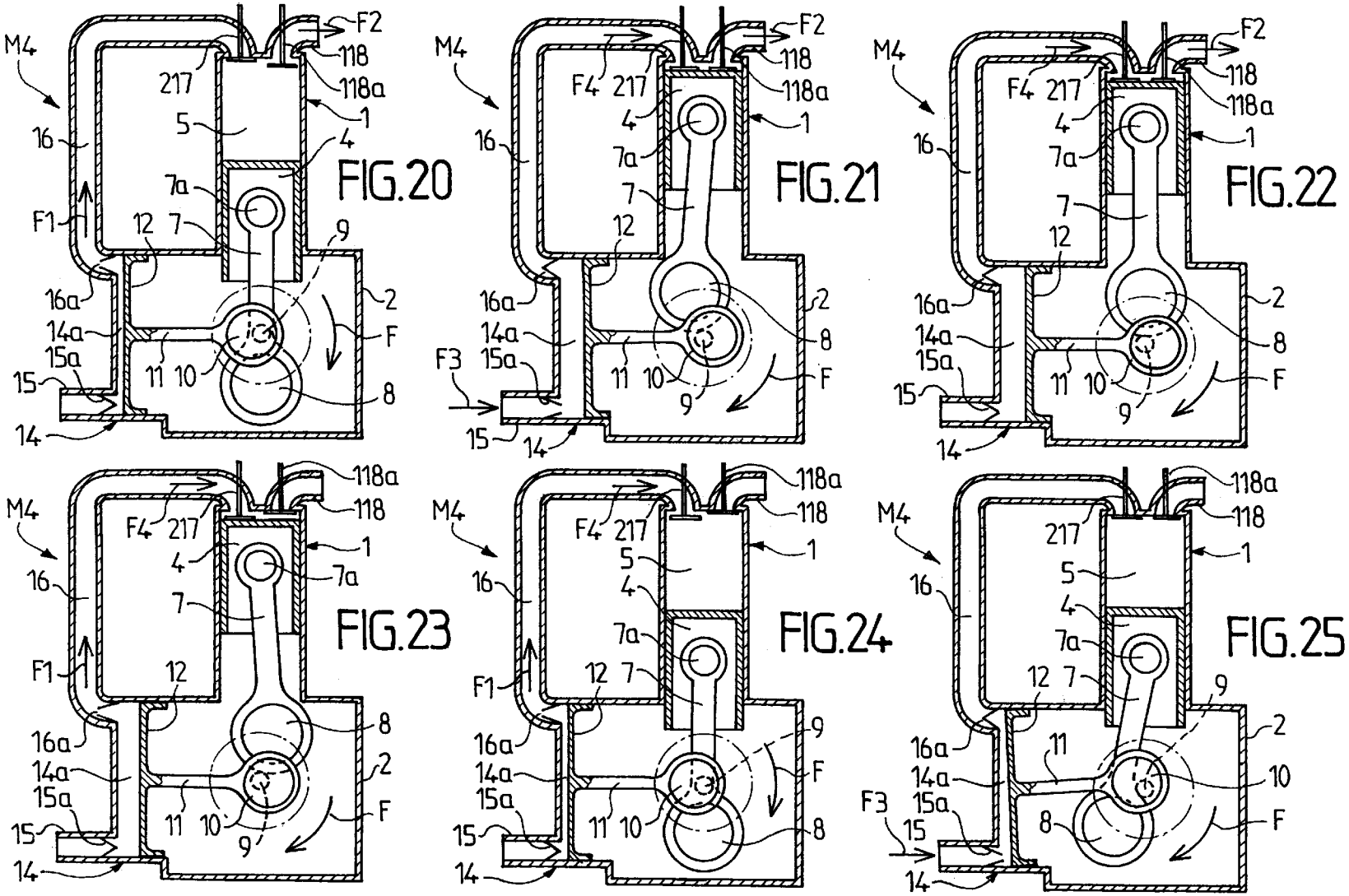

At the end of the expansion stroke, the engine piston 4 reaches its BDC, as illustrated in FIG. 20, after a rotation of about a further 30° in the clockwise direction as indicated by the arrow F. In this position, the compressor piston 12 has finished rocking about its lower portion to reach its position of maximum compression furthest to the left in the compression chamber 14*a*. The inlet valve 15*a* remains closed and the delivery valve 16*a* remains open to finish the further compressing of the air in the inlet pipe 16, as indicated by the arrow F1. In this position, the burnt gases continue to escape through the exhaust duct 118, in the direction of the arrow F2. The first stroke of the four-stroke cycle of the engine M4 has here been accomplished.

During later rotation of the crankshaft 9, as illustrated in FIG. 21, the engine piston 4 during the phase of compressing the combustion chamber, delivers the burnt gases to the exhaust duct 118. In the position illustrated in FIG. 21, the crankshaft is rotated through about a further 160°. In this position, the compressor piston 12 has rocked about its upper portion, then about its lower portion, to reach a position of expansion of the compression chamber 14*a*. During the expansion phase of the compressor 14. the inlet valve 15*a* is open and the delivery valve 16*a* is closed, so that fresh air is drawn into the compression chamber 14*a* as indicated by the arrow F3. At the same time, the inlet valve 217 opens to allow compressed air into the combustion chamber as illustrated by the arrow F4 and thus to drive the rest of the burnt gases toward the exhaust duct. FIG. 22 shows the end of the compression stroke of the engine piston 4, for which stroke the crankshaft 9 has covered a rotation of 360° with respect to its initial position illustrated in FIG. 18. In this position, the inlet valve 15*a* has closed and the two valves 217 and 118*a* remain open. The arrow F4 indicates the admission of compressed hot air into the combustion chamber. The position of FIG. 22 illustrates the second stroke of the four-stroke cycle.

To proceed to FIG. 23, the crankshaft 9 has pivoted through a further twenty or so degrees to begin the expansion phase of the engine piston 4. In this position, the exhaust valve 118*a* has closed again but the inlet valve remains open. The delivery valve 16*a* also opens to deliver the fresh air contained in the compression chamber 14*a* into the inlet pipe 16 as indicated by the arrow F1. When the engine piston 4 reaches its BDC as illustrated in FIG. 24, that is to say during the third stroke of the four-stroke cycle, the combustion chamber 5 has been filled with hot compressed air from, on the one hand, the compressed air contained in the inlet pipe 16 and, on the other hand, the compressed air contained in the compression chamber 14*a* and delivered by the compressor piston 12, given that the delivery valve 16*a* has remained open. Double filling of the combustion chamber 5 has thus been achieved.

The orientation of eccentric 10 with respect to wrist pin 8 is chosen as a function of the length of inlet pipe 16 for generating a pressure wave in the compressor chamber 14*a* sufficiently before closing inlet valve 217 so that, at a synchronized operating speed ω, the peak of this pressure wave reaches cylinder 1 substantially at the instant inlet valve 217 is shut off.

FIG. 25 depicts the additional rotation of the crankshaft 9 through about 30° In this position, the two valves 217 and 118*a* are closed and the start of compression of the air contained in the combustion chamber 5 is achieved. The delivery valve 16*a* is also closed, but the inlet valve 15*a* is open to once again allow fresh air into the compression chamber 14*a*. At the end of the compression stroke of the engine piston 4, at the latest, the fuel can be injected into the combustion chamber 5. Then, the engine piston 4 reaches its TDC, as illustrated in FIG. 18.

Figure 26:
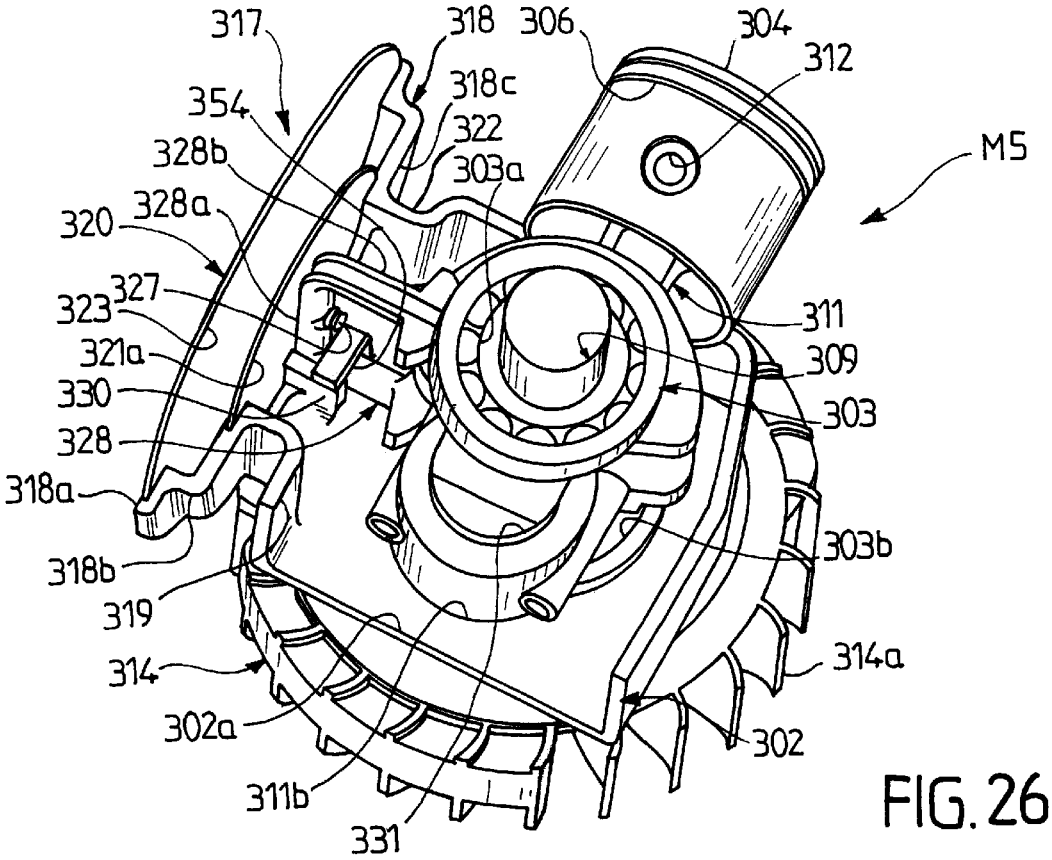
FIG. 26 is a perspective view of a single-cylinder two-stroke engine according to a fourth embodiment of the invention, the engine piston being at its top dead center (TDC), the engine cylinder being omitted and the crankcase being shown in half section.
Figure 27:
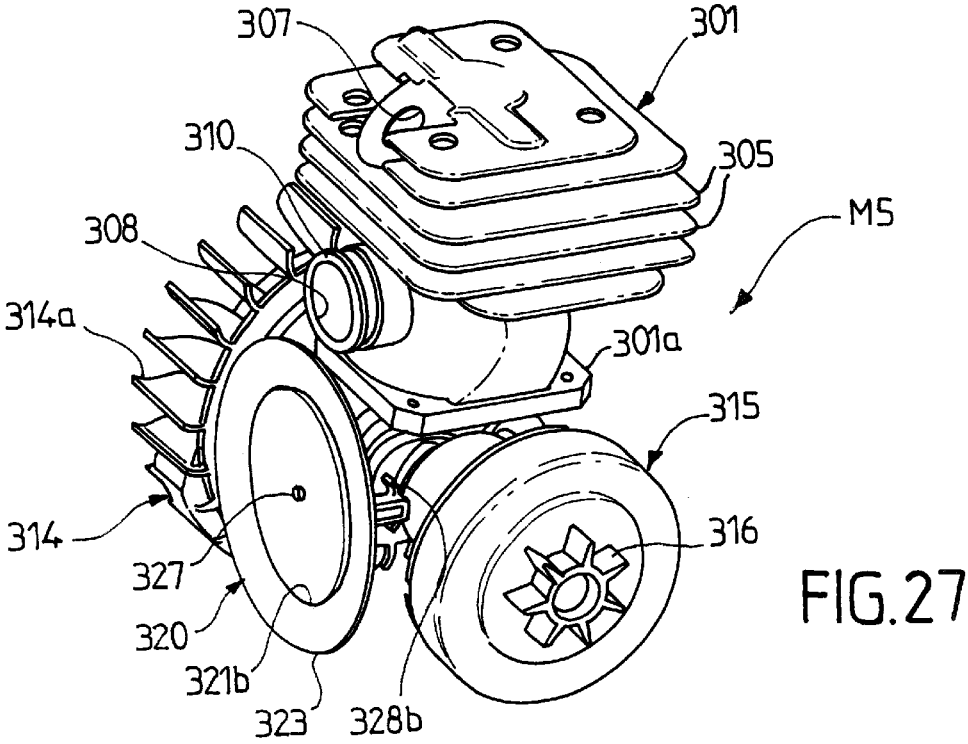
FIG. 27 is another view in perspective of the engine of FIG. 26, the compressor cylinder and the crankcase being omitted.

A fourth embodiment of an engine according to the invention, intended in particular for a cutter, is described now with reference to FIGS. 26 and 27.

The engine M5 is a single-cylinder two-stroke engine comprising a cylinder block 301 inside which there is formed a cylinder into which is fitted an engine piston 304 equipped at its periphery with sealing rings 306. The cylinder block 301 is fixed, at a fixing flange 301*a* to the upper wall of a crankcase 302 which is parallelepipedal overall. The cylinder block 301 bears cooling fins 305 on its outer face. A bore 307 is formed in the top of the cylinder block 301 to accommodate a spark plug, not depicted. The cylinder block 301 has, on its side wall, a flange 310 with a bore 308 and which is intended to house an exhaust manifold. Although not depicted, an air inlet circuit is of course also provided.

A crankshaft 309 is mounted so that it can rotate in the crankcase 302 by means of two ballbearings 303, the respective outer races 303*b* of which are fixed into opposite side walls 302*a* of the crankcase 302 and the respective inner races of which are fixed to the crankshaft 309. The engine piston 304 is coupled to the crankshaft 309 by a connecting rod 311, the small end of which is articulated to the piston 304 by a pivot pin 312 and the big end 311*b* of which is fixed pivotally to a wrist pin 331 of the crankshaft 309. As the engine operates, the reciprocating movement of the engine piston 304 in the engine cylinder drives the crankshaft 309 in rotation according to the known art.

Fixed to one end of the crankshaft 309 is a flywheel 314 which is fitted with blades 314*a* so that it acts at the same time as a cooling fan and is made of magnetic material so that as it rotates it induces an electric voltage in a stator winding, not depicted. This induced voltage powers the spark plug and makes it possible to dispense with equipping the engine M5 with an electric battery. Mounted at the other end of the crankshaft 309 is a clutch 315 allowing the crankshaft 309 to be coupled to an output pinion 316 for driving a chain of a cutter.

The engine M5 is equipped with a compressor 317, depicted partially in FIGS. 26 and 27. The compressor 317 comprises a cylinder the axis of which is oriented at right angles to the axis of rotation of the crankshaft 309 and at right angles to the axis or the engine cylinder and a compressor piston 320. A base part 318 of the compressor cylinder is formed as a single piece with the crankcase 302 and is connected via a cylindrical connecting wall 322 to a side wall 319 of the crankcase 302 which is parallel to the axis of rotation of the crankshaft 309. The base part 318 of the cylinder comprises a bottom wall 318*c* parallel to the wall 319 and having a circular opening at its center. The internal face of the bottom wall 318*c* has, around the central opening, a counterbore intended to accommodate the edge of a thrust washer 321*a* of the compressor piston 320 when the latter is at its bottom dead center, as in FIG. 26. The bottom wall 318*c* is extended by a cylindrical side wall 318*b* which defines the section of the compression chamber of the compressor 317. The cylindrical side wall 318*b* is extended by a rim 318*a* projecting radially outward. The rim 318*a* has a counterbore to house part of the edging of a disk-shaped diaphragm 323 and constitutes a fixing flange for assembling a cylinder head part 324 of the compressor, this part being depicted in FIG. 32.

A central part of the diaphragm 323 is sandwiched between the thrust washer 321*a* and a second thrust washer 321*b* of the compressor piston 320. A fixing element 327, for example a screw, a rivet or a pin and snap ring assembly, is engaged through the center of the thrust washers 321*a–b* and of the diaphragm 323 to join them together in a sealed manner and to assemble the thrust washer 321*a* with a piston guide 328 for driving the piston 320, which therefore comprises the thrust washers 321*a–b* and the diaphragm 323, all assembled. The diaphragm 323 is made of a sealed and flexible material, for example a thin sheet of steel, of silicone or of elastomer of the rubber type.

Figure 32:
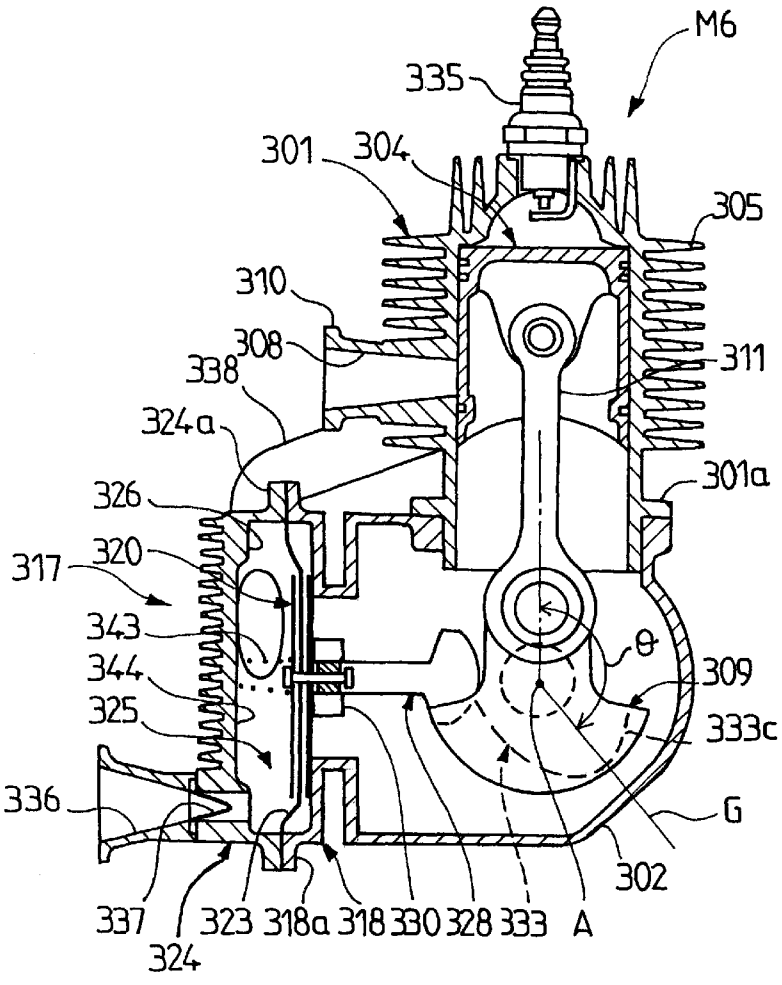

With reference to FIG. 32, having assembled the cylinder head part 324 on the base part 318 of the compressor cylinder, the edging part of the diaphragm 323 finds itself trapped in a sealed manner, between the rim 318*a* and a corresponding rim 324*a* on the cylinder head part 324. The diaphragm 323 delimits a variable-volume compression chamber 325 between itself and the end wall 326 of the cylinder head part 324. The cylinder head part 324 and the base part 318 together define the compressor cylinder. The end wall 326 has a cylindrical counterbore 344 to accommodate the washer 321*b* when the compressor piston 320 is at its top dead center. The washers 321*a* and 321*b* are designed to maximize the volume of air displaced in the compressor cylinder. However, their diameter is sufficiently smaller than the inside diameter of the compressor cylinder that an intermediate portion of the diaphragm 323 is allowed to deform freely between the washers 321*a* and 321*b* and the side wall of the compressor cylinder. A coil spring 343 is arranged in the compression chamber 325 with one end bearing against the wall 326 and the other end bearing against the washer 321*b*, so as to urge the piston 320 and the piston guide 328 toward the crankshaft 309.

Returning to FIGS. 26 and 27, the piston guide 328 is a U-shaped hoop, the base 328*a* of which is fixed against the thrust washer 321*a* and the two branches 328*b* of which extend parallel to the axis of the compressor cylinder along the side walls 302*a* of the crankcase 302 which are, at right angles, adjacent to the side wall 319. Aligned with each of the two opposed walls 302*a*, the cylindrical connecting wall 322 bears, on its internal face, a pair of guide ribs 330 which are spaced apart so as to receive between them a branch 328*b* to guide it in translation along the axis of the compressor cylinder.

The piston guide 328 and the crankshaft 309 will be described in greater detail with reference to FIG. 28.

As has been stated, the crankshaft 309 comprises an end part 309*a*, of cylindrical section, intended to receive the flywheel 314, another end part 309*b*, opposite to and coaxial with the part 309*a*, and which has a frustoconical shape and is intended to collaborate with the clutch 315. The parts 309*a* and 309*b* define the axis of rotation of the crankshaft 309, denoted by A. Between them is arranged a cylindrical wrist pin 331, the axis of which is parallel to and offset from the axis of rotation A and which is assembled with the parts 309*a* and 309*b* by two respective connecting plates 332 which are symmetric with respect to the mid-plane of the wrist pin 331. The connecting plates 332 respectively bear the parts 309*a* and 309*b* practically at the center of the opposite face to the wrist pin 331.

Each connecting plate 332 is, in the thickness direction, in the form of two half-plates of different outline. In the case of each plate 332, the half-plate adjoining the wrist pin 331 has, at right angles to the axis A, a pear-shaped section comprising a narrow end part 332*a*, the peripheral edge of which is roughly semicylindrical and which carries the wrist pin 331, a middle part 332*b*, the peripheral edge of which is concave and describes an angular sector of about 60°, and a wide end part 332*c*, the peripheral edge of which is practically in the shape of a portion of a cylinder over an angular sector of about 120° with a radius twice that of the part 332*a*. The edge of the part 332*c* meets the concave edge of the part 332*b* at a rounded shoulder 332*d* of accentuated curvature. The part 332*c* is off-centered away from the wrist pin 331 with respect to the axis A to form a counterweight. This counterweight is commonly designed to compensate for all of the rotating mass formed by the wrist pin 331 and part, for example 50%, of the reciprocating mass formed by the engine piston 304 and the connecting rod 311. A flat chamfer 335 is formed in the opposite face to the wrist pin 331, at the end of the part 332*a*.

For each connecting plate 332, the other half-plate, in the thickness direction, has a peripheral edge 333 shaped with the desired cam profile. At the middle part 332*b*, the peripheral edge 333 has a part 333*b* aligned with the concave edge of the part 332*b* of the other half-plate. At the end facing toward the wrist pin 331, the edge 333 has a part 333*a* in the shape of an arc of a circle set back radially from the semicylindrical edge of the part 332*a* and of lesser curvature. A flat chamfer 336 is formed on the outer face of this half-plate at the end facing toward the wrist pin. At the end facing away from the wrist pin 331, the edge 333 has a practically semicylindrical part 333*c* with more accentuated curvature than the edge of the part 332*c*. The edge part 333*c* is tangential to the edge of the part 332*c* at the opposite end of the plate 332 to the wrist pin 331. This area 333*d* of tangency constitutes that part of the edge 333 whose radial distance from the axis A is the greatest. The part of the edge 333 whose radial distance from the axis A is the shortest consists of the part 333*b* aligned with the concave edge of 332*b*.

Figure 30:
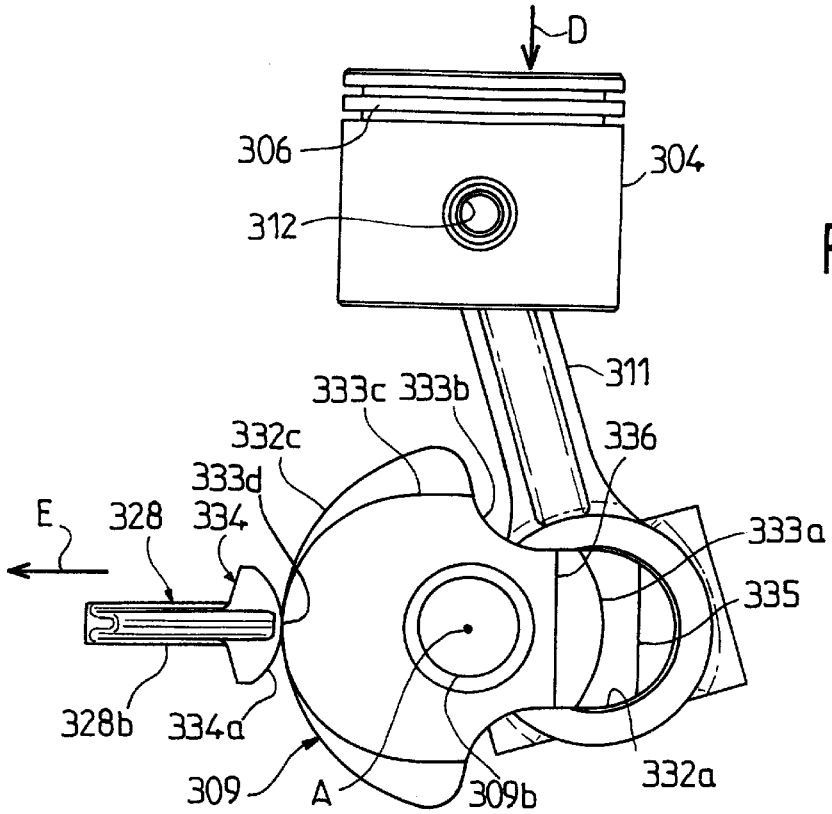
FIGS. 30 and 31 schematically illustrate two operating positions of the engine of FIG. 26 after, respectively, 90° and 270° of rotation of the crankshaft with respect to TDC of the engine piston.

It should be noted that the outline of the peripheral edge 333 described above corresponds to a specific case in which the portion 333*d* of edge 333, which ensures a maximum travel of the compressor piston, is located at 180° from the wrist pin. This specific case is also depicted in FIG. 30. However, the cam profile portion which ensures the maximum travel of the compressor piston can also be located at any other position on the cam profile, as a function of the intended application.

Figure 31:
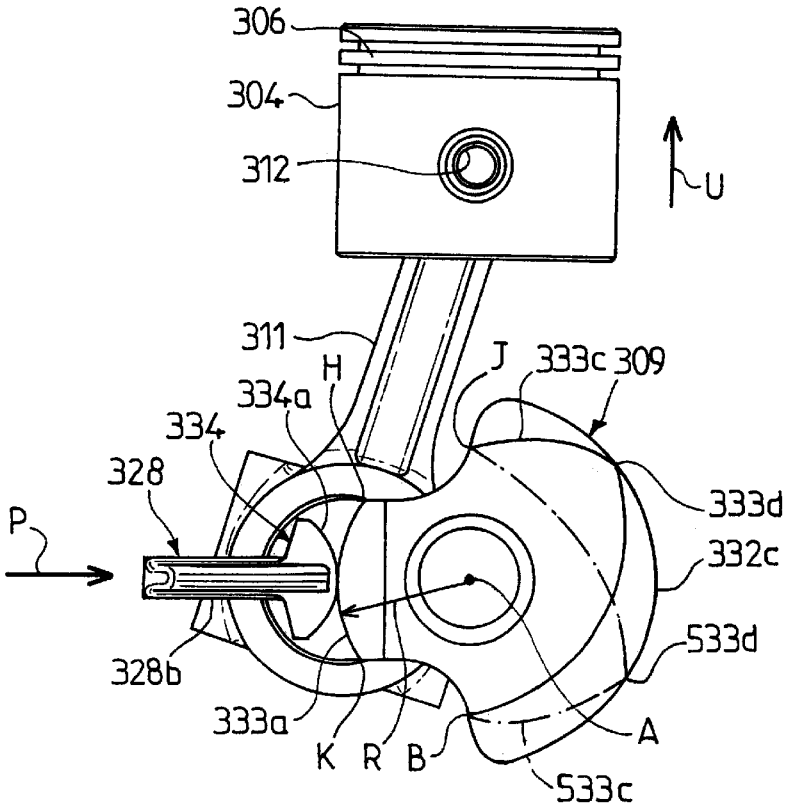

On FIG. 31, two modified embodiments of the cam profile are shown. In a first modified embodiment, the area of tangency 333*d* between edge portion 333*c* and edge portion 332*c* is rotated by about 135° from the wrist pin clockwise. In a second modified embodiment, shown in dash-dot line, the area of tangency 533*d* between edge portion 533*c* and edge portion 332*c* is rotated by about 150° from the wrist pin counterclockwise.

For example, the edge 333 is produced by machining the opposite face to the wrist pin 331 of a connecting plate 332 which initially had a uniform cross section over its entire thickness. In this case, the half-plate facing toward the wrist pin is the one which is unaffected by the machining of the peripheral edge 333.

It will be noted that the crankshaft 309 is not significantly unbalanced by the removal of material resulting from the machining of the peripheral edge 333, because the amount of material concerned is small with respect to the entirety of the counterweight. However, it is possible to compensate for this removal of material by adding a corresponding amount of material to the half-plate facing toward the wrist pin.

The piston guide 328 is formed from a hollow profile two end parts of which are bent at right angles with respect to an intermediate part to form, respectively, the two branches 328*b* and the base 328*a* of a U. The piston guide 328 is symmetric with respect to a mid-plane which is vertical in FIG. 28. The base 328*a* at its middle carries a cylindrical sheath 328*d* to accommodate the fixing element 327. Each branch 328*b* at its end bears a sliding pad 334 in the form of a cylindrical sector the axis of which is directed parallel to the base 328*a* and the cylindrical wall 334*a* of which faces away from the base 328*a* to collaborate with the crankshaft 309. The separation between the two pads 334 coincides with the separation between the peripheral edges 333 formed in the two connecting plates 332 which means that the cylindrical wall 334*a* of each pad 334 comes into sliding contact with a respective edge 333.

Figure 28:
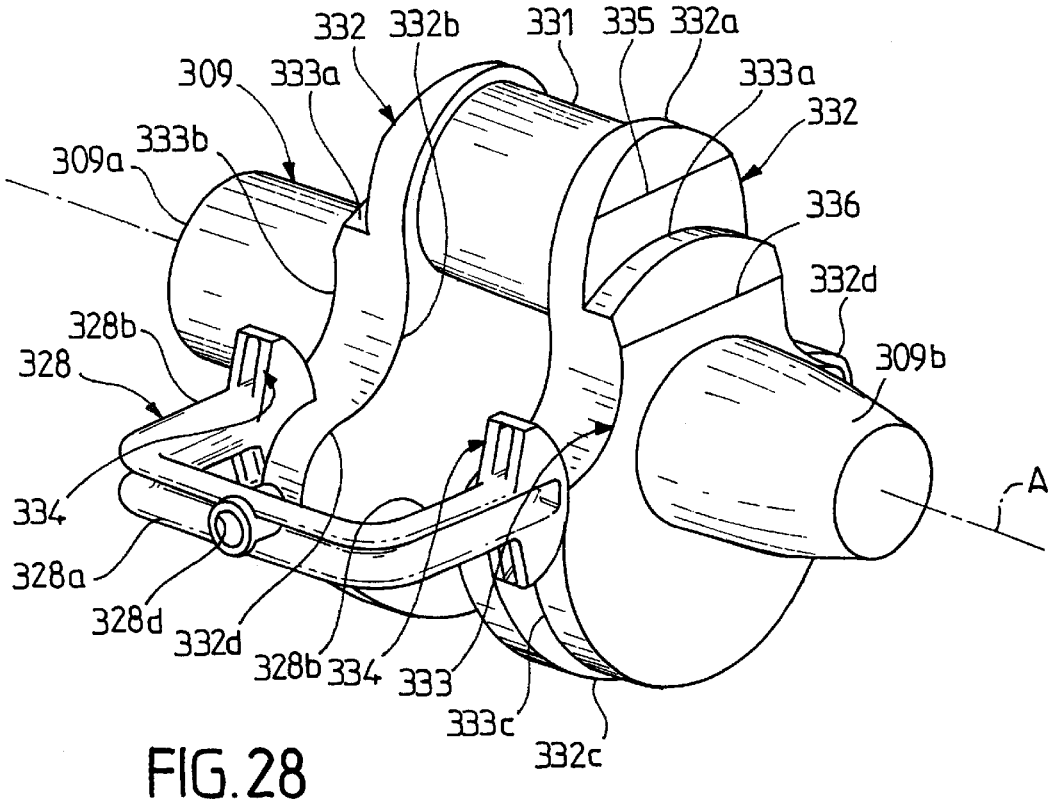
FIG. 28 is an enlarged perspective view of the crankshaft and of the cam follower member of the engine of FIG. 26.
Figure 29:
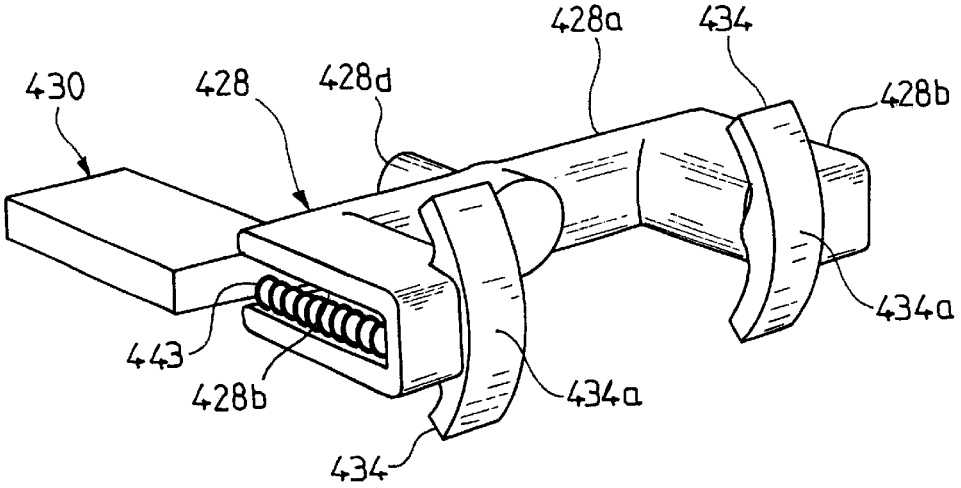
FIG. 29 is an enlarged perspective view of an alternative form of embodiment of the cam follower member of the engine of FIG. 26.

FIG. 29 depicts a piston guide 428 produced according to an alternative form of the piston guide 328 of FIG. 28. The parts of the piston guide 428 which are similar to those of the piston guide 328 carry the same reference numeral increased by 100. The main difference between these two embodiments is that the pads 334 of the piston guide 328 lie in the continuation of the branches 328*b*, while the pads 434 of the piston guide 428 are offset toward one another with respect to the branches 428*b*. The angle of the cylindrical sector formed by the pads 334 and 434 is, for example, between 120° and 180°. The piston guide 428 works in the same way as the piston guide 328 and is used when it is necessary to provide a certain separation between the connecting plate 332 of the crankshaft and the side wall 302*a* of the crankcase 302.

As visible in FIG. 29, each of the branches 428*b* has a longitudinal groove in its external side intended to face a side wall of the crankcase. This groove accommodates a compressible spring 443 for urging the piston guide 428 toward the crankshaft, not shown. In this case, each wall 302*a* of the crankcase, shown on FIG. 1, is equipped with a guide rib 430 located so as to slide into the longitudinal groove of the branch 428*b*. The guide rib 430 guides in translation the piston guide 428 and compresses the spring 443 between the guide rib and an end wall of the groove as the piston guide 428 moves away from the crankshaft.

One example of the operation of the engine M5 described hereinabove is now described with reference to FIGS. 30 and 31. In these figures, the only things depicted are the engine piston 304, which is assumed to be driven in reciprocating movement in an engine cylinder, not depicted, the crankshaft 309, which is driven in rotation with respect to the crankcase, not depicted, by the connecting rod 311 of the piston 304, and the piston guide 328, which is assumed to be guided in translation with respect to the crankcase, not depicted, parallel to the axis of the compressor cylinder, not depicted, and to be connected to the compressor piston, not depicted, in order to drive it. Furthermore, an elastic member, not depicted, returns the piston guide 328 toward the crankshaft 309 in such a way as to keep the pads 334 in contact with the edges 333.

In FIG. 30, the engine piston 304 has, under the pressure of the combustion gases produced in the engine cylinder, traveled half of its expansion stroke from its top dead center in the direction of the arrow D. At the same time, the crankshaft 309 has rotated through 90°. During this rotation, each pad 334 has slid along one of the edges 333, which are identical, and more specifically along the part 333*c* of said edge 333, with an increase of the distance to the axis A, until it reaches the region 333*d*. The piston guide 328 has thus been separated from the crankshaft 309 against the action of the elastic return member, in the direction of the arrow E. In the position depicted in FIG. 30, the piston guide 328 is distanced by its maximum amount, which corresponds to the top dead center of the compressor piston, not depicted. It should be noted that FIG. 30 shows, as does FIG. 28, a specific embodiment of the cam profile, in which the portion ensuring a maximum travel of the compressor piston is located at 180° from the wrist pin.

In FIG. 31, the engine piston 304 has traveled beyond its bottom dead center and has performed half of its compression stroke in the engine cylinder, in the direction of the arrow U. The crankshaft 309 has at the same time rotated through a further 180° with respect to FIG. 30. During this rotation, each pad 334 has slid along the part 333*c* of the edges 333 with a decrease in the distance to the axis A. The piston guide 328 has thus moved closer to the crankshaft 309 under the thrust of the elastic return member, in the direction of the arrow P, until it came into abutment against two stopper plates 354, one of which is shown in FIG. 1, and each of which is secured on a respective pair of the guide ribs 330 in the crankcase of the engine.

It should be noted that when the base 328*a* of piston guide 328 abuts against the stopper plates 354, the wall 334*a* of pads 334 is at a distance from axis A which is substantially equal to the radius R of the arc of a circle depicted by the edge portion 333*a*, or hardly larger. In fact, the piston guide 328 remains substantially at rest and in abutment against the stopper plates 354 during a whole portion of the rotation cycle of the crankshaft 309; that is while the portion of the cam profile defined by the series of points B, K, H, J (see FIG. 31) faces the pads 334.

The points B and J, which represent the ends of edge portion 333*c* are at a distance from axis A which is substantially equal to radius R, so that the contact between piston guide 328 and edge portion 333*c* is established and interrupted in a smooth and tangential fashion during the operating cycle of the engine.

It will be appreciated that the edge 333 thus constitutes a cam profile which drives the piston guide 328, and therefore the compressor piston, in a reciprocating movement as the crankshaft rotates, making it possible to compress air in the compressor cylinder. The profile of the edges 333 may be arranged to drive one or more reciprocating movements of the piston guide 328 for each revolution of the crankshaft.

It should be noted that a means other than an elastic member may be used to keep the piston guide 328 in contact with the crankshaft 309, for example the engaging of a stud in a groove.

The engine M5 equipped with the compressor 317 can be used to generate compressed air that can be collected at the outlet of the compressor cylinder to meet a requirement for compressed air, for example to power a pneumatic actuator or some other device. An alternative form of embodiment of the engine M5, in which alternative form the compressor 317 is used to supercharge the engine, will now be described with reference to FIGS. 32 and 33.

The engine depicted in FIG. 32, denoted overall by M6, has only a few structural differences by comparison with the engine M5 of FIGS. 26 and 27, which means that the same reference numerals are used to denote elements which are identical or similar to those of the engine M5.

The spark plug 335 is arranged at the top of the cylinder block 301. The engine M6 consists of the cylinder block 301, of a second unit which forms the crankcase 302 and of a third unit which forms the cylinder head part 324 of the compressor cylinder, which part also bears cooling fins 341. The compressor piston 320 is moved back and forth inside the compression chamber 325 of the compressor 317 attached to the crankcase 302. The compression chamber 325 of the compressor 317 is supplied with carbureted mixture or with fresh air via an intake pipe 336 equipped with a nonreturn intake valve 337. The carbureted mixture or the fresh air under pressure is discharged from the compressor 317 toward an inlet pipe 338 equipped with a nonreturn delivery valve, similar to the valve 16*a* in the previous embodiments. The inlet pipe 338 opens into the bottom part of the engine cylinder 339 through one or more port(s) 340 oriented such that the mixture or the air under pressure is introduced with a looping upward rotating movement into the cylinder 339. The bore 308 of the fixing flange 310 for the exhaust manifold opens at the bottom part of the cylinder 339, practically at the same level as the inlet port or ports 340.

In an alternative form of embodiment which has not been depicted, the inlet pipe 338 is equipped with a heat exchanger carrying a coolant, for example water, or alternatively blown fresh air in the case of an air-cooled engine, to cool the air leaving the compressor 317, making it possible to increase the mass of air let into the engine cylinder 339.

Figure 33:
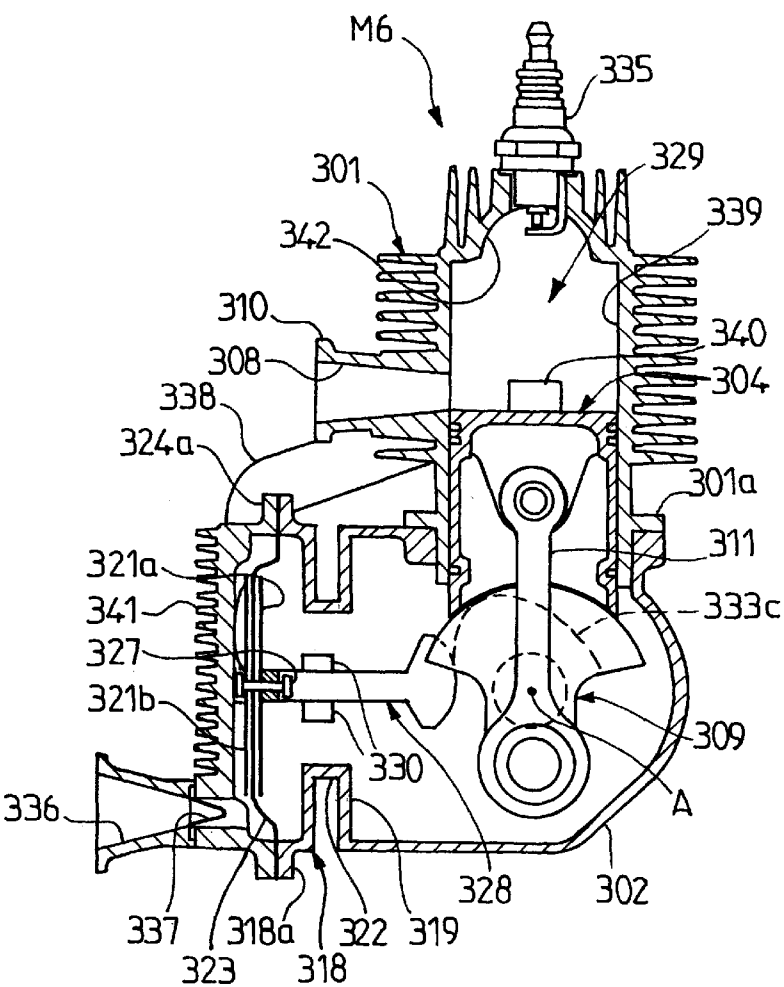
FIGS. 32 and 33 show, in cross section, an alternative form of embodiment of the engine of FIG. 26, in two operating positions corresponding, respectively, to TDC and BDC of the engine piston.

The way in which the engine M6 works will now be described. In FIG. 32, the engine piston 304 is at the end of its compression stroke, at its TDC, while the compressor piston 320 is at its BDC, that is to say in its position furthest to the right in FIG. 32. During expansion, under the action of the combustion of the gases in the combustion chamber 329, defined in the cylinder 339 between the piston 304 and the cylinder head 342, the engine piston 304 descends to its BDC, as illustrated in FIG. 33, simultaneously uncovering the exhaust duct and the inlet port or ports 340. During this movement, the compressor piston 320 is pushed back toward its TDC by the piston guide 328 sliding against the edge 333, and this causes air or carbureted mixture to be let under pressure into the combustion chamber, thus driving the burnt gases toward the exhaust and filling the cylinder 339.

During its compression phase, from its BDC to its TDC, the engine piston 304 shuts off both the exhaust and the inlet. At the same time, the piston guide 328, sliding against the edge 333, causes the compressor piston 320 to return to its BDC. Fresh air or carbureted mixture is then drawn through the intake pipe 336 because of the depression thus generated in the chamber 325. The operating cycle which has just been described is thus performed repetitively.

In the engine M6, the edge 333 of the crankshaft 309, which acts as a cam profile to drive the compressor piston 320, is produced differently from the embodiment of FIG. 28. The part 333*c* of the edge 333 describes a practically half-ellipse contour, the major half-axis G of which is offset by an angle θ about the axis A with respect to the half-plane delimited by the axis A and containing the axis of the wrist pin 331. The major half-axis G defines the point on the edge 333 which is the greatest distance away from the axis A, and whose passage under the piston guide 328 corresponds to the TDC position of the compressor piston 320. The angle θ, which measures about 120° in the example depicted, is chosen as a function of the angle β formed between the engine cylinder and the compressor cylinder, which measures about 270° in the example depicted, and of the desired phase shift φ between TDC of the piston 304 and TDC of the piston 320, according to the formula: $\phi=\beta-\theta$, all angles being considered positive in the direction of rotation of the crankshaft 309. This then yields a phase shift φ of about 150° in the example depicted, as can be seen in FIG. 34.

The geometry of the edge 33 is chosen so as to coordinate the movements of the engine piston 304 and of the compressor piston 320, to obtain the operation which will now be explained with reference to FIGS. 34 and 35.

Figure 34:
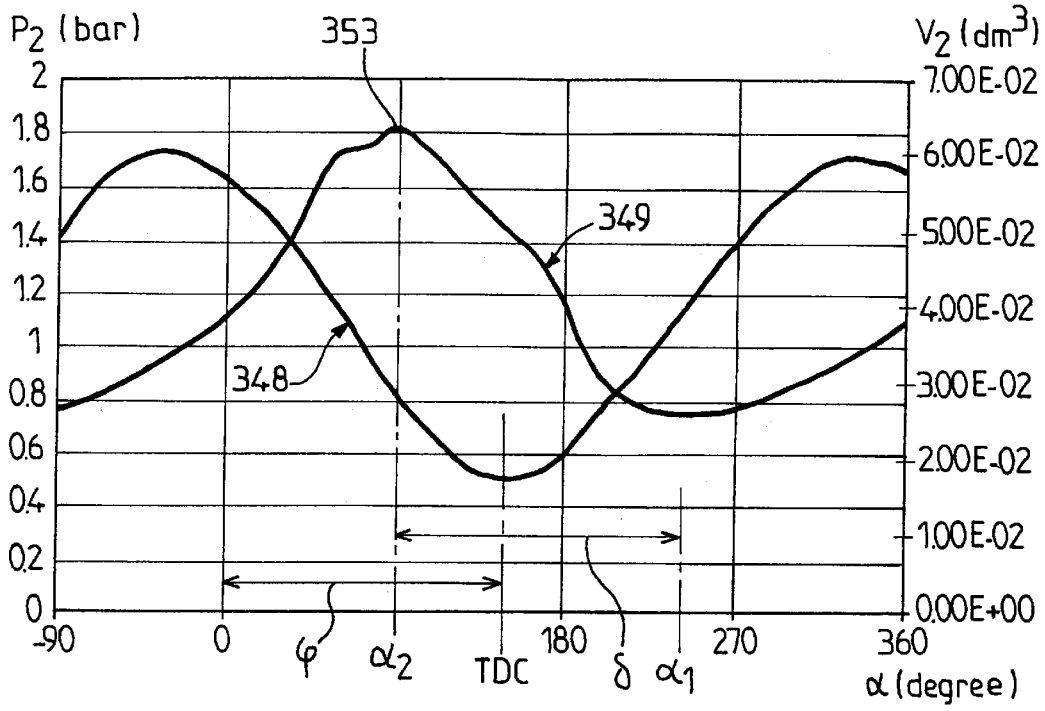
FIG. 34 depicts, for an operating cycle of the engine of FIG. 32, the volume of the compression chamber of the compressor and the change in the pressure in the compression chamber.
Figure 35:
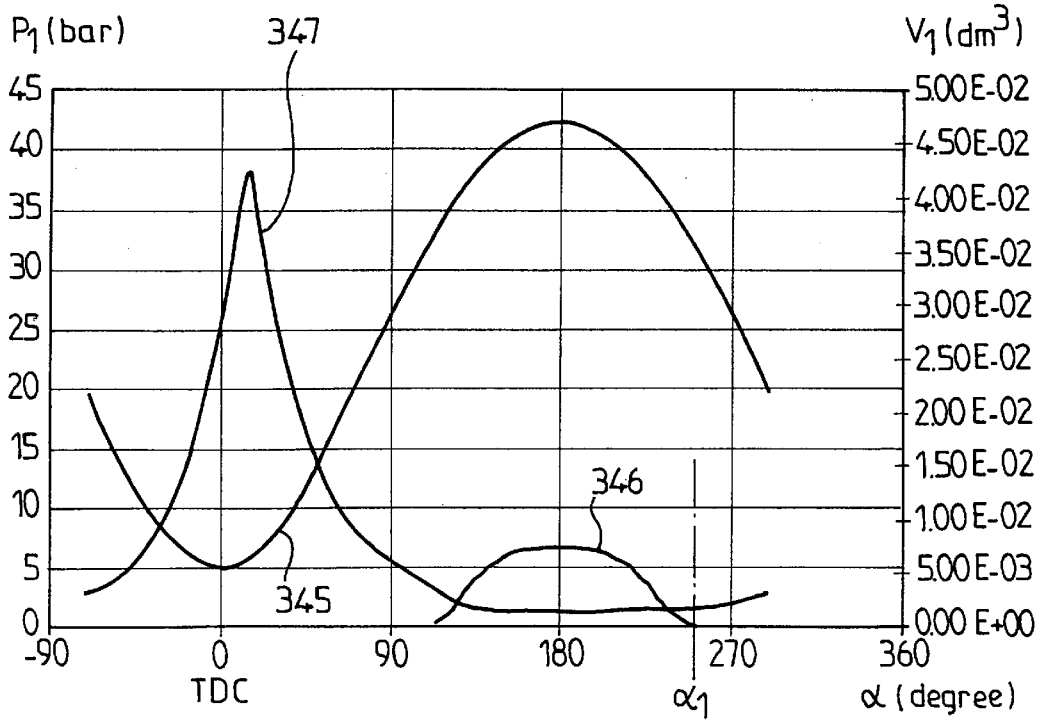
FIG. 35 depicts, in a similar way to FIG. 34, the volume of the combustion chamber of the engine, the pressure in the combustion chamber and the state of an inlet member of the engine cylinder.

In FIGS. 34 and 35, the X-axis represents the angle of rotation α of the crankshaft, in degrees, the origin being positioned at top dead center of the engine piston 304. In FIG. 35, the curve 345 represents the volume $V_1$ of the combustion chamber 329. The curve 346 represents, qualitatively, the cross-sectional opening of the inlet port or ports 340. Thus, the inlet ports are open, that is to say uncovered by the piston 304, over a range of about 130° centered on the BDC position of the piston 304. The curve 347 represents the pressure $P_1$ in the combustion chamber 329. In FIG. 34, the curve 348 represents the volume $V_2$ of the compression chamber 325. The curve 349 represents the pressure $P_2$ in the compression chamber 325.

When the compressor piston 320, under the thrust of the piston guide 328, performs its compression stroke between $\alpha=-30°$ and $\alpha=150°$, the volume $V_2$ diminishes. At the beginning of this completion stroke, the nonreturn valve mounted in the inlet pipe 338 is closed and the pressure $P_2$ rises. At a certain point on this compression stroke, which depends in particular on the properties of the nonreturn valve, the valve opens and a pressure wave is propagated at the speed of sound along the inlet pipe 338 from the compression chamber 325 to the engine cylinder 339. In FIG. 34, the start of this pressure wave, which corresponds practically to the obtaining of a spike 353 in the pressure $P_2$ in the compression chamber 325, is identified by the angle $\alpha_2$. The edge 333 is designed so that the emission of this pressure wave occurs a little δ in advance of the shutting-off of the inlet port or ports 340, which instant is identified by the angle $\alpha_1$ in FIG. 35.

More specifically, the movements of the engine piston 304 and of the compressor piston 320 are coordinated so that, at a synchronized operating speed ω, which is the speed for which maximum torque or mechanical power is to be obtained on the engine output pinion 316, the peak of the pressure wave propagating from the compressor 317 reaches the cylinder 339 at practically the same instant as the inlet port or ports 340 is or are shut off, which instant is identified by the angle $\alpha_1$ in FIG. 35. The propagation time T of this pressure wave through the inlet pipe 338 is equal to the length of the pipe divided by the speed of sound. The production of the pressure spike 353 in the compression chamber 325 and the shutting-off of the inlet member 40 are therefore positioned in such a way as to satisfy the formula: $\delta=\alpha_1-\alpha_2=\omega T$, which is achieved by choosing a certain value for the phase shift φ when the position of the shutting-off of the inlet member with respect to the TDC of the engine piston 304 and the position of the pressure spike 353 in the compression chamber 325 with respect to the TDC of the compressor piston 320 are known.

Such adjustment makes it possible, at the chosen synchronized operating speed ω, to maximize the boost pressure in the combustion chamber of the engine and therefore improve the efficiency and power of the engine, and to reduce exhaust pollution.

Figure 36:
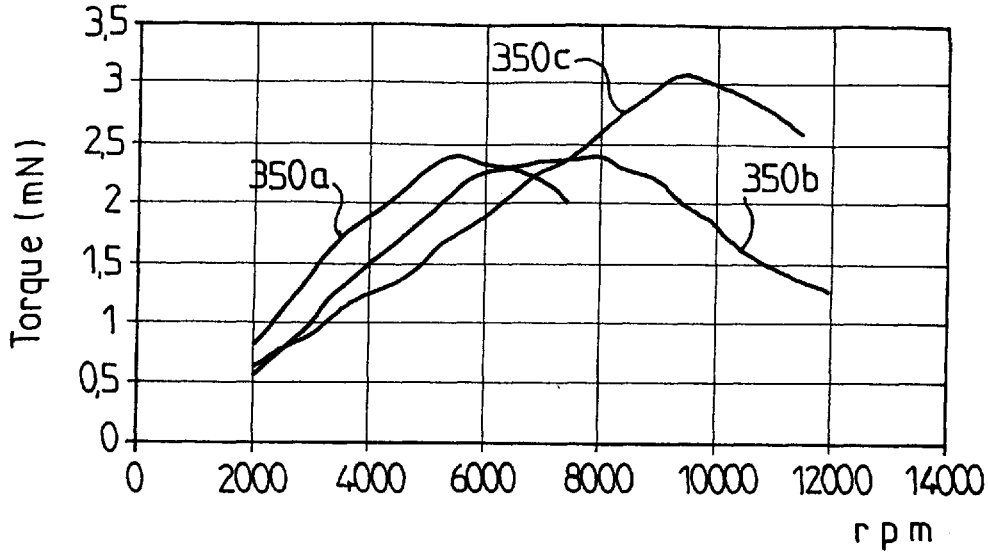
FIGS. 36 and 37 depict, for three separate types of engine, the respective output torque and output mechanical power as a function of the operating speed.
Figure 37:
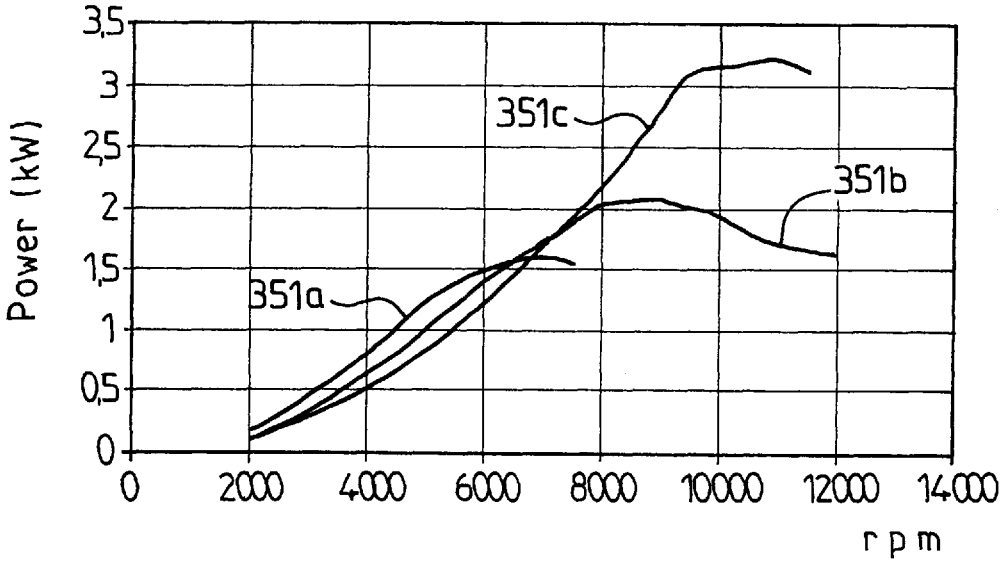

The value chosen for the synchronized operating speed ω of course depends on the application of the engine. FIGS. 36 and 37 depict, for three different types of engine, a respective typical behavior of the engine torque, in FIG. 36, and of the mechanical power, in FIG. 37, as a function of the operating speed of the engine. The curves 350*a* and 351*a* relate to an industrial engine, the curves 350*b* and 351*b* to a cutter engine, and the curves 350*c* and 351*c*, to an engine for a two-wheeled vehicle. Thus, the synchronized operating speed ω is typically chosen to be in a range between 5000 and 7000 rpm for an industrial engine, in a range between 7000 and 9000 rpm for a cutter engine and in a range between 9000 and 11000 rpm for the engine of a two-wheeled vehicle. However, other values may also be chosen for the synchronized operating speed ω, depending on the requirements specific to each application.

Although this is not depicted, the various engines of the invention may be fitted with injectors for the direct or indirect injection of petrol or diesel, or may alternatively operate using precarburated mixtures.

Figure 16:
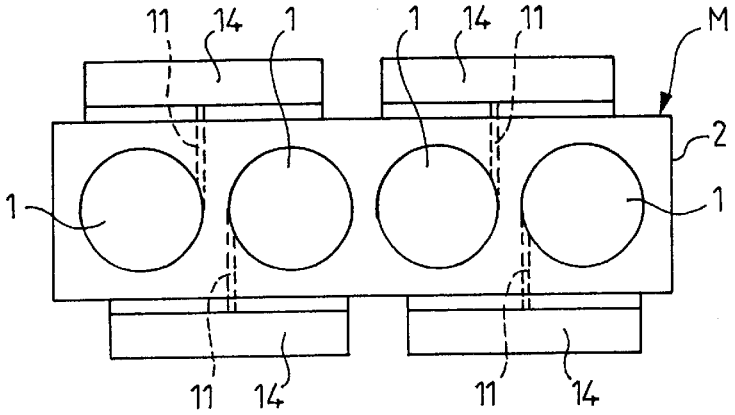
FIG. 16 is a diagrammatic view from above of an in-line four-cylinder engine according to the invention.

Finally, FIG. 16 depicts an engine M with four inline cylinders 1 having four compressors 14 of the single-stage type with rocking compressor piston, the link rods 11 of which are depicted off-centered from the axis of the respective cylinder, the compressors 14 being arranged on each lateral face of the crankcase 2, alternately.

Of course, the invention is just as applicable to all types of single- or multi-cylinder engines, in an in-line or V configuration.

Although the invention has been described in conjunction with a number of particular embodiments, it is quite obvious that it is not in any way restricted thereto and that it encompasses all technical equivalents of the means described and combinations thereof if these fall within the context of the invention.

What is claimed is:

1. A two-stroke or four-stroke internal combustion engine, operating by admitting a carbureted mixture or by admitting fresh air with the direct or indirect injection of fuel, the engine having at least one engine cylinder, an engine piston which executes a reciprocating movement in said engine cylinder, said engine piston coupled by a connecting rod to a wrist pin of a crankshaft so as to drive said crankshaft in rotation, and at least one compressor having a compressor cylinder and a compressor piston engaged in said compressor cylinder so as to define at least one variable-volume compression chamber, wherein said compression chamber is connected to said engine cylinder by an inlet pipe in order to supercharge the engine cylinder with carbureted mixture or with fresh air, said inlet pipe ending at an inlet member of the engine cylinder, wherein said engine comprises a coupling means for coupling said compressor piston to said crankshaft, said coupling means arranged to drive said compressor piston in a reciprocating movement in said compressor cylinder in coordination with the movements of said engine piston as said crankshaft rotates, wherein said compressor piston produces a supercharging pressure spike in said compressor cylinder at a certain point of a compression stroke of said compressor piston, wherein said coupling means is designed as a function of a length of said inlet pipe and a predetermined operating speed so that said supercharging pressure spike propagating through said inlet pipe between said compressor cylinder and said engine cylinder reaches said engine cylinder at practically the same time as said inlet member is shut off when the engine operates at said predetermined speed.

2. The engine according to claim 1, wherein said coupling means comprises a cam follower member connected to said compressor piston to drive said compressor piston, said cam follower member being kept in contact with a cam profile carried by said crankshaft during at least part of a rotation cycle of said crankshaft, said cam profile being designed to drive said compressor piston via the cam follower member, with a reciprocating movement in said compressor cylinder as said crankshaft rotates.

3. The engine according to claim 2, wherein the crankshaft has a counterweight part which is off-centered away from said wrist pin to balance said crankshaft, part of said cam profile being carried by said counterweight part.

4. The engine according to claim 3, wherein the cam follower member has the overall shape of a U with two branches and collaborates with said counterweight part of the crankshaft on each side of said wrist pin via respective ends of the two branches of said cam follower member.

5. The engine according to claim 4, wherein the compressor piston is connected to said cam follower member practically at the middle of a base of said cam follower member connecting the two branches, so that an axis of said compressor piston is practically coplanar with an axis of the engine piston.

6. The engine according to claim 2, further comprising a crankcase in which said crankshaft is mounted so that it can rotate, said crankcase carrying means for guiding said cam follower member in translation in an axial direction of the compressor cylinder.

7. The engine according to claim 2, wherein the compressor piston comprises a flexible sealed diaphragm, a peripheral edging of which is fixed in a sealed manner to a side wall of the compressor cylinder and at least one rigid plate fixed against a central part of said diaphragm, said at least one rigid plate being connected to said cam follower member so as to be driven back and forth with respect to the compressor cylinder, an intermediate part of said diaphragm located between said central part and said peripheral edging being able to deform as said at least one rigid plate moves.

8. The engine according to claim 2, wherein the cam follower member is arranged between said compressor piston and said crankshaft, an elastic return means being arranged to return said compressor piston and said cam follower member toward said crankshaft.

9. The engine according to claim 8, wherein said elastic return means is a compressible spring arranged in said compression chamber and bearing on said compressor piston.

10. The engine according to claim 8, wherein said elastic return means is arranged between said cam follower member and a crankcase of said engine.

11. The engine according to claim 2, further comprising an abutment member borne by a crankcase of said engine to stop said cam follower member at an abutment position during another part of said rotation cycle of the crankshaft during which said cam follower member is no more in contact with said cam profile.

12. The engine according to claim 2, wherein the cam profile has an angular region which, when it collaborates with said cam follower member, brings said compressor piston into a position corresponding to the production of a supercharging pressure spike in said compression chamber, the angle of a dihedron, the vertex of which is formed by the axis of rotation of the crankshaft and the two half-planes of which extend one toward said wrist pin and the other toward said angular region of the cam profile, being calculated as a function of said predetermined operating speed and of a length of said inlet pipe so as to allow said supercharging pressure spike propagating through said inlet pipe between said compression chamber and said engine cylinder to reach said engine cylinder at practically the same time as said inlet member is shut off.

13. The engine according to claim 1, wherein said inlet member comprises at least one port arranged in a lower part of said engine cylinder so as to be uncovered by said engine piston when said engine piston is in a range around its bottom dead center, and to be shut off by said engine piston during the remainder of the cycle of said engine piston.

14. The engine according to claim 1, wherein said inlet member comprises a controlled intake valve arranged at the top of said engine cylinder.

15. The engine according to claim 1, wherein the predetermined operating speed corresponds to obtaining a maximum torque or a maximum mechanical power on the output shaft of said engine.

16. The engine according to claim 1, wherein said coupling means comprises an eccentric mounted on the shaft of said crankshaft and a link rod articulated to the eccentric and coupled to the compressor piston.

17. The engine according to claim 16, wherein the angle of a dihedron, the vertex of which is formed by the axis of rotation of the crankshaft and the two half-planes of which extend one toward the eccentric and the other toward the wrist pin is designed as a function of a length of said inlet pipe so as to obtain a phase shift between the top dead center positions of the engine and compressor pistons associated with the respective engine and compressor cylinders that are connected through said inlet pipe, wherein said phase shift ensures that a supercharging pressure spike propagating through said inlet pipe between said compressor cylinder and said engine cylinder reaches said engine cylinder at practically the same time as said inlet member is shut off when the engine operates at said predetermined speed.

18. The engine according to claim 1, characterized in that the capacity of the compressor cylinder is of the order of magnitude of that of the engine cylinder, but with a compressor piston which has a diameter markedly greater than the diameter of the engine piston, so that the compressor piston has a short compression stroke in the compression chamber.

19. The engine according to claim 16, characterized in that the compressor piston (112, 212) is secured at its center to a rod (121) articulated to the link rod (111) for connection to the eccentric (10), said rod being guided in translation in a direction which intersects the axis of the cylinder (1).

20. The engine according to claim 16, characterized in that the compressor piston is a deformable diaphragm connected at its periphery to the side wall of the compression chamber.

21. The engine according to claim 16, characterized in that the compressor piston is a rigid cylinder (112) which can move in axial translation and is fitted at its periphery with at least one sealing ring.

22. The engine according to claim 16, characterized in that the compressor piston (12) is rigidly attached at its center to the link rod (11) for connection with the eccentric (10) so that the compressor piston moves in the compression chamber (14*a*) by rocking back and forth about lower and upper parts of the compression chamber, the axis of the compressor (14) being offset, in the direction of the axis of the crankshaft (9), with respect to the axis of the cylinder (1).

23. The engine according to claim 22, characterized in that the compressor piston (12) has, at its periphery, a spherical edging (12*a*) fitted with a spherical sealing ring (13) which is preferably unable to rotate with respect to the compressor piston, in a position such that the gap in the ring is not placed at the bottom of the compressor (14).

24. The engine according to claim 1, characterized in that the compression chamber has two stages (14*a*, 14*b*) located one on each side of the compressor piston (112, 212), a first stage (14*a* or 14*b*) being supplied with carbureted mixture or with fresh air by a first nonreturn valve (115*a*) or a valve, and connected by a delivery duct (130) fitted with a second nonreturn valve (130*a*) or a valve to the second stage (14*b* or 14*a*) which communicates with the engine cylinder (1) via said inlet pipe (16) possibly fitted with a third nonreturn valve (16*a*) or a valve.

25. Two-stroke internal combustion engine according to claim 1, characterized in that it is equipped with an additional volume (40, 140) communicating with the engine cylinder (1) through closure and opening means (42, 44; 142, 144), the movements of which are controlled either in synchronism or with a phase shift with respect to those of the engine piston (4) in the engine cylinder so that during the expansion phase, the burnt gases compress the air in the additional volume and at least partially enter it, so that this air and burnt gases mixture is trapped under pressure therein, and then so that this mixture is admitted into the engine cylinder during the compression phase.

26. The engine according to claim 25, characterized in that after the air and burnt gases mixture previously trapped in the additional volume (40, 140) has been admitted into the engine cylinder (1), said additional volume is once again filled with fresh air from the compressor (14).

27. The engine according to claim 25, characterized in that the aforementioned closure and opening means comprise two rotary shutters (42, 44; 142, 144), for example multi-way rotary spools, connected to each other by the additional volume (40, 140), one (42, 142) of the shutters being associated with the compressor (14), and the other shutter (44,144) being associated with the exhaust from the engine cylinder (1).

28. The engine according to claim 27, characterized in that the two rotary shutters are arranged in such a way that the following operations take place: in a first phase, when the engine piston (4) is near its TDC, a flow of air from the compressor (14) passes through the lower shutter (42, 142) associated with the compressor, sweeps through the additional volume (40, 140), passes through the upper shutter (44, 144) associated with the exhaust and is exhausted to the outside via an exhaust manifold; in a second phase, from about halfway through the expansion stroke of the engine piston, on the one hand, the upper shutter (44, 144) places the engine cylinder (1) in communication with the additional volume so as to fill it with a pressurized mixture of air and burnt gases and, on the other hand, the engine cylinder communicates with the exhaust; in a third phase, the upper shutter traps the air and burnt gases mixture in the additional volume; in a fourth phase, air from the compressor (14) is admitted into the engine cylinder and, in a fifth phase, at the start of the engine piston compression stroke, the trapped and pressurized mixture is admitted into the engine cylinder.

29. The engine according to claim 28, characterized in that the upper shutter (44) is connected to the engine cylinder (1) by a pipe (45) arranged toward the bottom of the engine cylinder and the lower shutter (42) is fitted on the delivery pipe (130) between the two stages (14*a*, 14*b*) of the compressor (14) so that the additional volume (40) is pressurized by means of the burnt gases from the engine cylinder (1) through the upper shutter (44) and is emptied into the engine cylinder through the pipe (45) connected to the upper shutter.

30. The engine according to claim 28, characterized in that the upper shutter (144) is associated with at least one exhaust valve (118*a*) located at the top of the engine cylinder (1) by a pipe (141) arranged toward the bottom of the engine cylinder so that the additional volume (140) is pressurized via its upper end by the burnt gases from the exhaust valve (118*a*) through the upper shutter (144) and is emptied into the engine cylinder via its lower end through the lower shutter (142).

31. The engine according to claim 1, characterized in that it is of loop scavenging type (M1), in which said inlet pipe (16) opens via ports (17) into the lower part of the cylinder (1) with an orientation such that the mixture or the air is introduced with a looping upward rotating movement, while the burnt gases from the previous cycle are discharged through exhaust ports (8) also arranged toward the bottom of the cylinder.

32. The engine according to claim 1, characterized in that it is of the uniflow type (M2), wherein said inlet member comprises inlet ports distributed at the base of the cylinder and supplied by a ring (117) for admitting the carbureted mixture or the air toward the bottom of the cylinder (1), said ring connected to the compressor (14), while the burnt gases from the previous cycle are discharged through one or more exhaust valves (118*a*) located at the top of the cylinder.

33. The engine according to claim 1, characterized in that it is of the type with several in-line cylinders (M), in which the compressors (14) associated with each cylinder (1) are arranged alternately on each face of the crankcase (2).

34. A two-stroke or four-stroke internal combustion engine, operating by admitting a carbureted mixture or by admitting fresh air with the direct or indirect injection of fuel, the engine having at least one engine cylinder, an engine piston which executes a reciprocating movement in said engine cylinder, said engine piston coupled by a connecting rod to the wrist pin of a crankshaft so as to drive said crankshaft in rotation, and at least one compressor having a compressor cylinder and a compressor piston engaged in said compressor cylinder so as to define at least one variable-volume compression chamber, said engine further comprising a cam follower member connected to said compressor piston to drive said compressor piston, said cam follower member being kept in contact with a cam profile carried by said crankshaft during at least part of a rotation cycle of said crankshaft, said cam profile being designed to drive said compressor piston via the cam follower member, with a reciprocating movement in said compressor cylinder as said crankshaft rotates.

35. A method for designing a two-stroke or four-stroke internal combustion engine operating by admitting a carburated mixture or by admitting fresh air with the direct or indirect injection of fuel, the method comprising the steps of:

providing an engine having at least one engine cylinder, an engine piston which executes a reciprocating movement in said engine cylinder, said engine piston coupled by a connecting rod to a wrist pin of a crankshaft so as to drive said crankshaft in rotation, and at least one compressor having a compressor cylinder and a compressor piston engaged in said compressor cylinder so as to define at least one variable-volume compression chamber;

providing an inlet pipe having a length for connecting said compression chamber to said engine cylinder in order to supercharge the engine cylinder with carburated mixture or with fresh air, said inlet pipe ending at an inlet member of the engine cylinder;

providing a coupling means for coupling said compressor piston to said crankshaft, said coupling means arranged to drive said compressor piston in a reciprocating movement in said compressor cylinder in coordination with the movements of said engine piston as said crankshaft rotates, wherein said compressor piston produces a supercharging pressure spike in said compressor cylinder at a certain point of a compression stroke of said compressor piston;

selecting a predetermined operating speed; and designing said coupling means as a function of said length of the inlet pipe and said predetermined operating speed so that said supercharging pressure spike propagating through said inlet pipe between said compressor cylinder and said engine cylinder reaches said engine cylinder at practically the same time as said inlet member is shut off when the engine operates at said predetermined speed.

* * * * *